US010044149B2

(12) United States Patent
Tanaka et al.

(10) Patent No.: US 10,044,149 B2
(45) Date of Patent: Aug. 7, 2018

(54) FEMALE AND MALE CONNECTORS

(71) Applicant: Yazaki Corporation, Tokyo (JP)

(72) Inventors: Yasuhiro Tanaka, Shizuoka (JP); Noboru Hayasaka, Shizuoka (JP); Yuhei Takeshita, Shizuoka (JP); Hiroaki Ono, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 20 days.

(21) Appl. No.: 15/592,883

(22) Filed: May 11, 2017

(65) Prior Publication Data

US 2017/0338600 A1 Nov. 23, 2017

(30) Foreign Application Priority Data

May 20, 2016 (JP) ..... 2016-101879
Feb. 6, 2017 (JP) ..... 2017-019948

(51) Int. Cl.
*H01R 13/6582* (2011.01)
*H01R 13/6592* (2011.01)
*H01R 24/28* (2011.01)

(52) U.S. Cl.
CPC ..... *H01R 13/6582* (2013.01); *H01R 13/6592* (2013.01); *H01R 24/28* (2013.01)

(58) Field of Classification Search
CPC ..... H01R 13/5219; H01R 13/5202; H01R 13/5205; H01R 13/4223; H01R 13/5208; H01R 43/005; H01R 13/521; H01R 2201/26; H01R 4/185; H01R 13/52; H01R 2107/00; H01R 24/58; H01R 4/70; H01R 13/113
See application file for complete search history.

(56) References Cited

U.S. PATENT DOCUMENTS 5,222,909 A * 6/1993 Nomura ..... H01R 13/6582 439/271
6,322,390 B1 * 11/2001 Takeuchi ..... H01R 24/542 439/289

(Continued)

FOREIGN PATENT DOCUMENTS

CN 201466409 U 5/2010
CN 206041155 U 3/2017

(Continued)

OTHER PUBLICATIONS

British Office Action for the related British Patent Application No. 1707107.7 dated Nov. 7, 2017.

*Primary Examiner* — Truc Nguyen
(74) *Attorney, Agent, or Firm* — Kenealy Vaidya LLP

(57) ABSTRACT

A female connector includes a female terminal, an inner housing which holds the female terminal, an outer housing relatively movable to the inner housing, tubular first shield shell integrated with the inner housing, and an elastic member which generates a resilient force. The male connector includes a male terminal, a housing which holds the male terminal, and the tubular second shield shell integrated with the housing. First shield shell abuts against the second shield shell on the connector insertion direction side with insertion of the connectors and is pressed against the second shield shell by the resilient force of the elastic member.

7 Claims, 20 Drawing Sheets

(56) References Cited

U.S. PATENT DOCUMENTS

| | | | | |
|---|---|---|---|---|
| 8,348,701 | B1 * | 1/2013 | Lan | H01R 12/707 439/607.19 |
| 2002/0002014 | A1 * | 1/2002 | Ichioka | H01R 9/05 439/625 |
| 2006/0105603 | A1 | 5/2006 | Nishio et al. | |
| 2007/0020978 | A1 | 1/2007 | Murakami et al. | |
| 2007/0149020 | A1 * | 6/2007 | Matsumoto | H01R 13/622 439/164 |
| 2007/0281552 | A1 * | 12/2007 | Gleissner | H01R 13/562 439/680 |
| 2009/0035976 | A1 * | 2/2009 | Matsunaga | H01R 13/5219 439/271 |
| 2009/0042438 | A1 * | 2/2009 | Iwahori | H01R 13/4365 439/521 |
| 2011/0207359 | A1 * | 8/2011 | Matsumoto | H01R 13/6275 439/347 |
| 2012/0135629 | A1 * | 5/2012 | Montena | H01R 13/622 439/359 |
| 2013/0244481 | A1 * | 9/2013 | Holland | H01R 24/46 439/578 |
| 2014/0011400 | A1 * | 1/2014 | Shiga | H01R 13/5205 439/587 |
| 2015/0194769 | A1 * | 7/2015 | Fujiwara | H01R 13/6581 439/607.04 |
| 2016/0043491 | A1 * | 2/2016 | Otsuta | H01R 13/6583 439/692 |

FOREIGN PATENT DOCUMENTS

| | | | |
|---|---|---|---|
| JP | 2006-331996 | A | 12/2006 |
| JP | 2014-103021 | A | 6/2014 |

* cited by examiner

FEMALE AND MALE CONNECTORS

CROSS-REFERENCE TO RELATED APPLICATION(S)

The present application claims priority to and incorporates by reference the entire contents of Japanese Patent Application No. 2016-101879 filed in Japan on May 20, 2016 and Japanese Patent Application No. 2017-019948 filed in Japan on Feb. 6, 2017.

BACKGROUND OF THE INVENTION

1. Field of the Invention

The present invention relates to female and male connectors.

2. Description of the Related Art

Conventionally, in a female connector and a male connector to be fitted to each other, there has been a technique of providing a metallic tubular shield shell in each synthetic resin housing to suppress entry of noise to a terminal or an electric wire inside the shield shells. This kind of female and male connector is disclosed, for example, in Japanese Patent Application Laid-open No. 2014-103021.

Incidentally, between the female connector and the male connector of the related art, when outer circumferential surface side of one of the shield shells comes into contact with inner circumferential surface side of the other of the shield shells in a direction orthogonal to a connector fitting direction, respective shield shells are electrically connected to each other. For this reason, when a female connector and a male connector are fitted to each other, the respective shield shells are fitted to each other, while sliding relative to each other. Also, originally, between the female connector and the male connector, a female terminal and a male terminal are also fitted to each other, while sliding relative to each other. In the female and male connectors having such a fitting structure, although rattling after the connector fitting is suppressed, it is necessary to apply a large insertion force when fitting. In addition, this indicates that a large extraction force is required when detaching the female connector and the male connector.

Further, Japanese Patent Application Laid-open No. 2006-331996 discloses a technique which has a lock lever for pressing a housing of one connector to a housing of the other connector in the connector fitting direction, and reduces the insertion force, by using the lock lever when fitting. Japanese Patent Application Laid-open No. 2006-331996 also discloses a rattling suppression structure after the connector fitting. The suppression structure includes inclined surfaces at the end portions of the housings of each connector on the connector fitting direction side, and an elastic member which presses the housing of one connector against the housing of the other connector in a state of causing the respective inclined surfaces to abut against each other. In the one connector, a housing having a two-piece structure of an outer housing and an inner housing capable of performing a relative movement in the connector fitting direction is provided, the elastic member is disposed between the outer housing and the inner housing, and the inner housing is pushed toward the housing of the other connector. Further, in the one connector, the outer circumferential surface of the end portion of the inner housing on the connector fitting direction side is inclined such that a size of an outer circumferential edge of a cross-section orthogonal to the connector fitting direction decreases as it goes in the connector fitting direction. Further, the inner circumferential surface of the end portion of the housing of the other connector on the connector fitting direction side is inclined such that a size of an inner circumferential edge of the cross-section orthogonal to the connector fitting direction increases as it goes in the connector fitting direction.

SUMMARY OF THE INVENTION

An object of the present invention is to provide female and male connectors capable of suppressing rattling after fitting the connectors, while reducing the insertion and extraction force at the time of inserting and extracting the connectors.

In order to achieve the above mentioned object, female and male connectors according to one aspect of the present invention includes a first connector provided with one terminal of a female terminal and a male terminal capable of being fitted to each other with insertion therebetween, an inner housing which holds the one terminal, an outer housing relatively movable to the inner housing in a connector insertion and extraction direction, tubular first shield shell integrated with the inner housing, and an elastic member which is disposed between the outer housing and the inner housing to exert an resilient force, toward a counterpart connector in the first connector's own connector insertion direction, on at least one of the inner housing and the first shield shell after fitting of the first connector and the counterpart connector; and a second connector as the counterpart connector provided with the other terminal of the female terminal and the male terminal, a housing which holds the other terminal, and tubular second shield shell integrated with the housing, wherein the first shield shell abuts against the second shield shell on the first connector's own connector insertion direction side with insertion of the first connector and the second connector, and is pressed against the second shield shell by the resilient force of the elastic member after fitting of the first connector and the second connector.

According to another aspect of the present invention, in the female and male connectors, it is preferable that the first shield shell and the second shield shell are configured so that at least a part of an outer circumferential surface of an end portion of one shield shell of the shield shells on the one shield shell's own connector insertion direction side is set as a first tapered surface inclined to the connector insertion and extraction direction, at least a part of an inner circumferential surface of an end portion of the other shield shell of the shield shells on the other shield shell's own connector insertion direction side is set as a second tapered surface inclined to the connector insertion and extraction direction, and the first tapered surface side and the second tapered surface side are made to abut against each other with the connector insertion.

According to still another aspect of the present invention, in the female and male connectors, it is preferable that the first tapered surface is inclined so that a size of an outer circumferential edge of a cross-section orthogonal to the connector insertion and extraction direction on the outer circumferential surface decreases toward the one shield shell's own connector insertion direction, and the second tapered surface is inclined so that a size of an inner circumferential edge of the cross-section orthogonal to the connector insertion and extraction direction on the inner circumferential surface increases toward the other shield shell's own connector insertion direction.

According to still another aspect of the present invention, in the female and male connectors, it is preferable that at least one of the first tapered surface and the second tapered surface is provided with at least one protruding portion protruding toward a counterpart tapered surface which is an abutment target.

According to still another aspect of the present invention, in the female and male connectors, it is preferable that one shield shell of the first shield shell and the second shield shell has a tapered surface inclined to the connector insertion and extraction direction, at an end portion on the one shield shell's own connector insertion direction side, the other shield shell of the first shield shell and the second shield shell has at least one protruding portion protruding toward the tapered surface, at an end portion on the other shield shell's own connector insertion direction side, and the first shield shell and the second shield shell make the tapered surface and the protruding portion to abut against each other with insertion of the first connector and the second connector.

According to still another aspect of the present invention, in the female and male connectors, it is preferable that the end portion of the other shield shell of the first shield shell and the second shield shell on the other shield shell's own connector insertion direction side extends in the other shield shell's own connector insertion direction side along the connector insertion and extraction direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
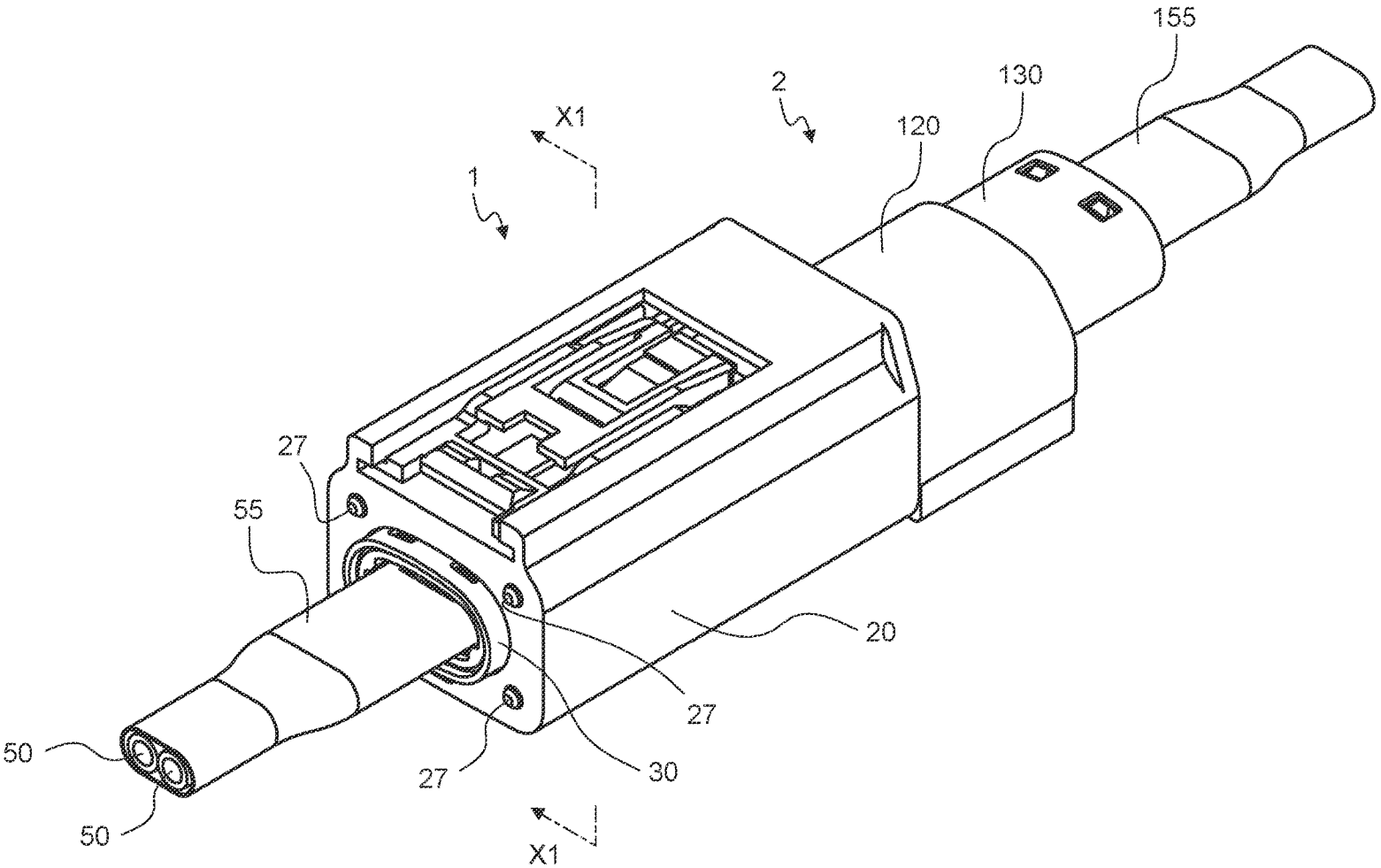
FIG. 1 is a perspective view illustrating a fitting state of a female connector and a male connector according to an embodiment.

Hereinafter, after illustrating the outline of the embodiment of the female and male connectors according to the present invention, a specific example of the embodiment will be described in detail with reference to the drawings. The present invention is not limited by this embodiment.

Embodiment

The female and male connectors of this embodiment include a first connector provided with one terminal of a female terminal and a male terminal capable of being fitted to each other with insertion therebetween, and a second connector provided with the other terminal of the female terminal and the male terminal. The first connector and the second connector are fitted into a counterpart connector by inserting into a counterpart connector to physically and electrically connect the female terminal and the male terminal. Further, when the first connector and the second connector are extracted from the counterpart connector, the physical and electrical connection between the female terminal and the male terminal is released. An insertion direction (a fitting direction) and an extraction direction are opposite to each other. Hereinafter, the insertion direction is referred to as a "connector insertion direction", the fitting direction is referred to as a "connector fitting direction", and the extraction direction is referred to as a "connector extraction direction". Each of these directions indicates the orientation of its connector with respect to the counterpart connector. Further, when the bidirectional orientations are not specified, they are referred to as a "connector insertion and extraction direction".

In the female and male connectors, the first connector is further provided with an inner housing which holds one terminal, an outer housing capable of relatively movable to the inner housing in a connector insertion and extraction direction, one tubular shield shell integrated with the inner housing, and an elastic member which is disposed between the outer housing and the inner housing to exert an resilient force on at least one of the inner housing and one shield shell after the connector fitting, toward a counterpart connector in the connector insertion direction of the first connector. Further, the second connector is further provided with a housing which holds the other terminal, and the other tubular shield shell integrated with the housing.

In the female and male connectors, one shield shell is configured to abut against the other shield shell on the connector insertion direction side with the insertion of the connectors, and is configured to be pressed against the other shield shell by the resilient force of the elastic member after the connector fitting. In this way, in the female and male connectors, the respective shield shells abut against each other with the insertion of the connectors, and unlike the related art, the shield shells are not fitted to each other, while causing the inner circumferential surface side and the outer circumferential surface side to slide. Accordingly, it is possible to reduce the insertion force at the time of fitting the connectors. Furthermore, since the female and male connectors can press each shield shell against each other after the connector fitting, it is possible to ensure the electrical connection state between the respective shield shells, and it is also possible to suppress an occurrence of rattling between the respective shield shells after fitting of the first connector and the second connector.

Here, each of the shield shells may cause, for example, the end surfaces on each connector insertion direction side to abut against each other, or may be provided with abutment sections at the end portions on each connector insertion direction side. However, it is preferable that each of the shield shells has an abutment section in order to improve the mutual electrical connection state. For example, each of the shield shells is configured so that at least a part of the outer circumferential surface of the end portion of one of the shield shells on the connector insertion direction side is set as a first tapered surface inclined to the connector insertion and extraction direction, at least a part of the inner circumferential surface of the end portion of the other of the shield shells on the connector insertion direction side is set as a second tapered surface inclined to the connector insertion and extraction direction, and the first tapered surface side and the second tapered surface side are made to abut against each other with the connector insertion. More specifically, the first tapered surface as one abutment section is inclined so that the size of the outer circumferential edge of the cross-section orthogonal to the connector insertion direction on the outer circumferential surface decreases toward the connector insertion direction of its own. Further, the second tapered surface serving as the other abutment section is inclined so that the size of the inner circumferential edge of the cross-section orthogonal to the connector insertion direction on the inner circumferential surface increases toward the connector insertion direction of its own. As a result, in each shield shell, the first tapered surface bites into the second tapered surface like a wedge after the connectors are fitted. Therefore, in the female and male connectors, an occurrence of rattling in the connector insertion and extraction direction between the shield shells after the connector fitting is suppressed, and it is also possible to suppress an occurrence of rattling in a direction orthogonal to the connector insertion and extraction direction.

One of specific examples of the female and male connectors is illustrated in FIGS. 1 to 12. In the following description, the first connector will be described as a female connector and the second connector will be described as a male connector. In the following description, a configuration in which the first tapered surface is provided in the female connector and the second tapered surface is provided in the male connector will be described.

Figure 2:
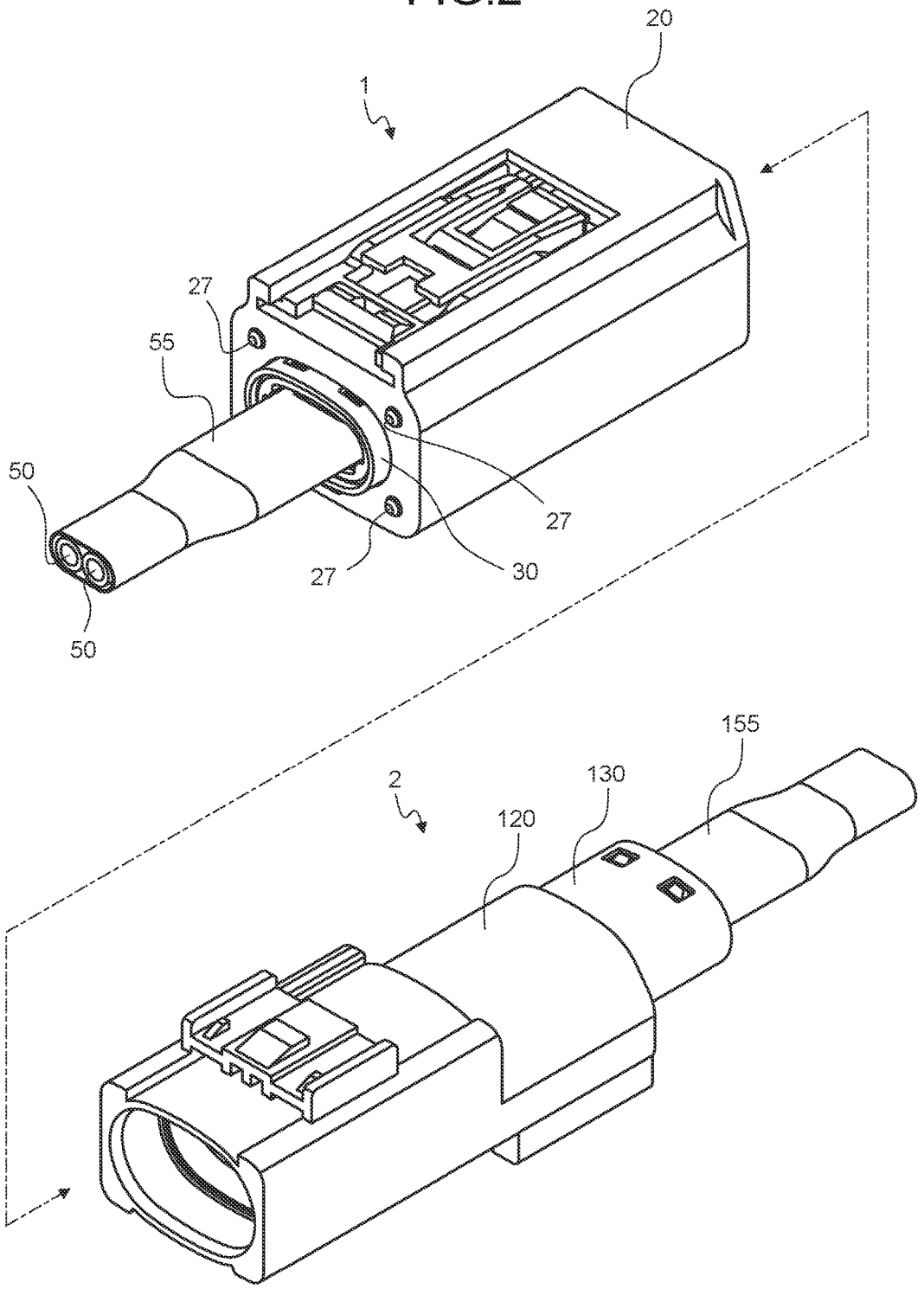
FIG. 2 is a perspective view illustrating a state before fitting of the female connector and the male connector according to the embodiment.
Figure 3:
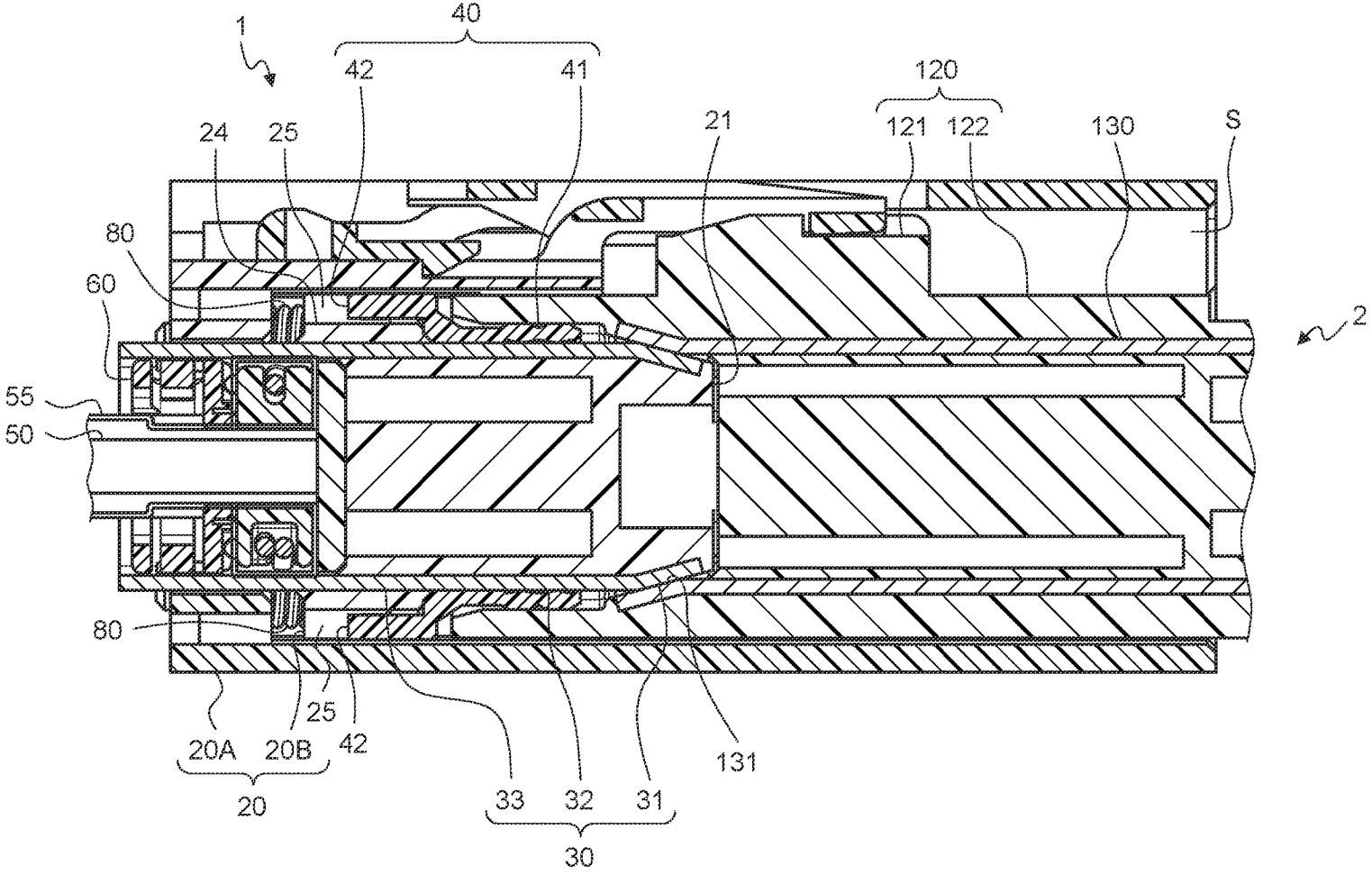
FIG. 3 is a cross-sectional view taken along a line X1-X1 of FIG. 1.

Reference numerals 1 and 2 in FIGS. 1 to 3 illustrate the female connector and the male connector of this embodiment, respectively.

A female connector 1 includes a terminal (a female terminal) 10 molded into a female shape by a conductive material such as metal, and a female housing 20 which holds the female terminal 10 inside (see FIGS. 4 to 8).

Furthermore, the female connector 1 is provided with a shield shell 30 integrated with the female housing 20. Furthermore, the female connector 1 is provided with a sealing member 40 which suppresses entry of liquid between the female connector 1 and a male connector 2. In the female connector 1, two female terminals 10 are arranged side by side in the same direction. Meanwhile, the male connector 2 is provided with a terminal (a male terminal) 110 molded into a male shape by a conductive material such as metal, a male housing 120 which holds the male terminal 110 inside, and a shield shell 130 integrated with the male housing 120 (FIGS. 9 to 12). In the male connector 2, two male terminals 110 are arranged side by side in the same direction.

Figure 7:
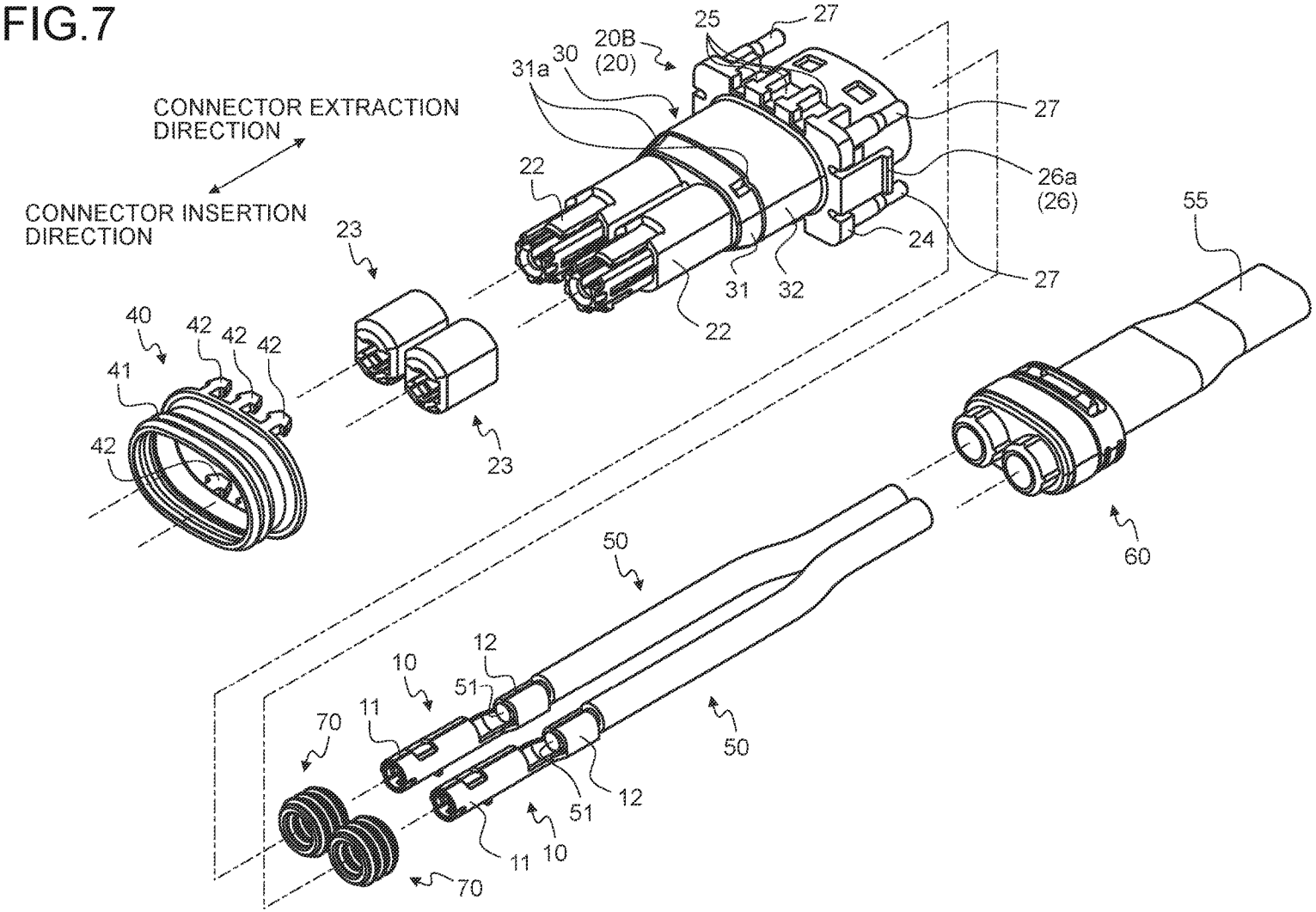
FIG. 7 is an exploded perspective view of internal components of the female connector according to the embodiment.
Figure 11:
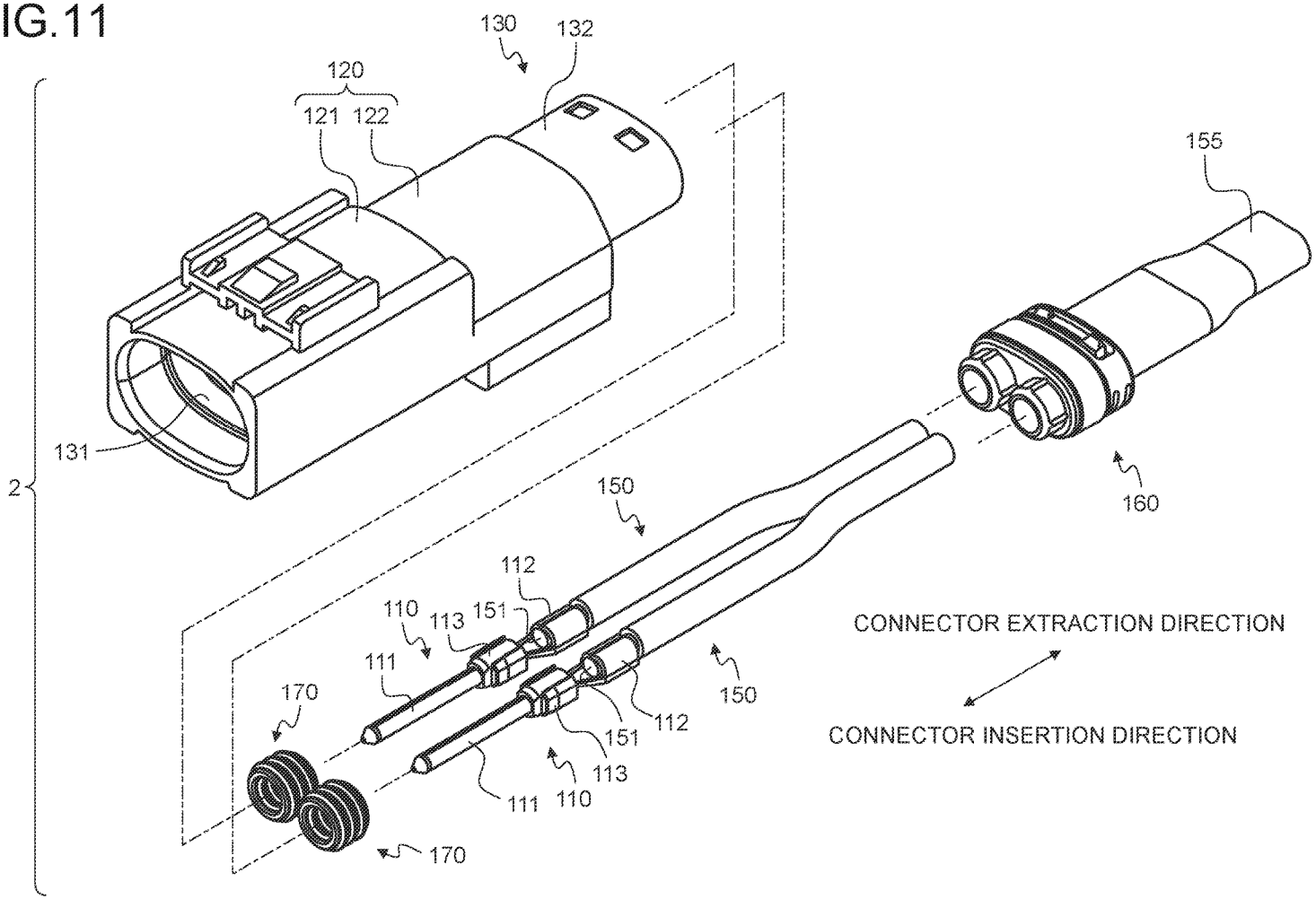
FIG. 11 is an exploded perspective view of the male connector of the embodiment.

The female terminal 10 has a terminal connecting section 11 which is physically and electrically connected to the male terminal 110, and an electric wire connecting section 12 which is physically and electrically connected to an electric wire 50 (FIG. 7). As with the female terminal 10, the male terminal 110 has a terminal connecting section 111 which is physically and electrically connected to the female terminal 10, and an electric wire connecting section 112 which is physically and electrically connected to an electric wire 150 (FIG. 11). In this example, the terminal connecting section 111 of the male terminal 110 is formed into a cylindrical shape in which an axial direction is made to match the connector insertion and extraction direction, and the terminal connecting section 11 of the female terminal 10 is formed into a cylindrical shape in accordance with this shape. In addition, the respective electric wire connecting sections 12 and 112 are formed so that the respective electric wires 50 and 150 can be drawn out in the connector extraction direction. Core wires 51 and 151 of the terminals of the electric wires 50 and 150 are fixed to the electric wire connecting sections 12 and 112 by crimping such as caulking.

The female housing 20 and the male housing 120 are molded into a predetermined shape by an insulating material such as a synthetic resin material. The female housing 20 and the male housing 120 of this example, as will be described in detail later, have a tubular hood with both ends open, and a terminal holding element which holds the terminals inside the hood. The hood uses the internal space as an accommodating chamber of the terminal, and is disposed in a state of integrating the terminal holding element in the internal space. In the hood, a tubular axis direction connecting the openings at both ends is a connector insertion and extraction direction, and the terminal connecting section 11 (111) is disposed at the end portion on the connector insertion direction side (the end portion on the counterpart connector side) inside the hood, and the electric wire connecting section 12 (112) is disposed at the end portion on the connector extraction direction side inside the hood. The terminal holding element inside the hood is formed so that such a terminal arrangement is permitted.

Figure 5:
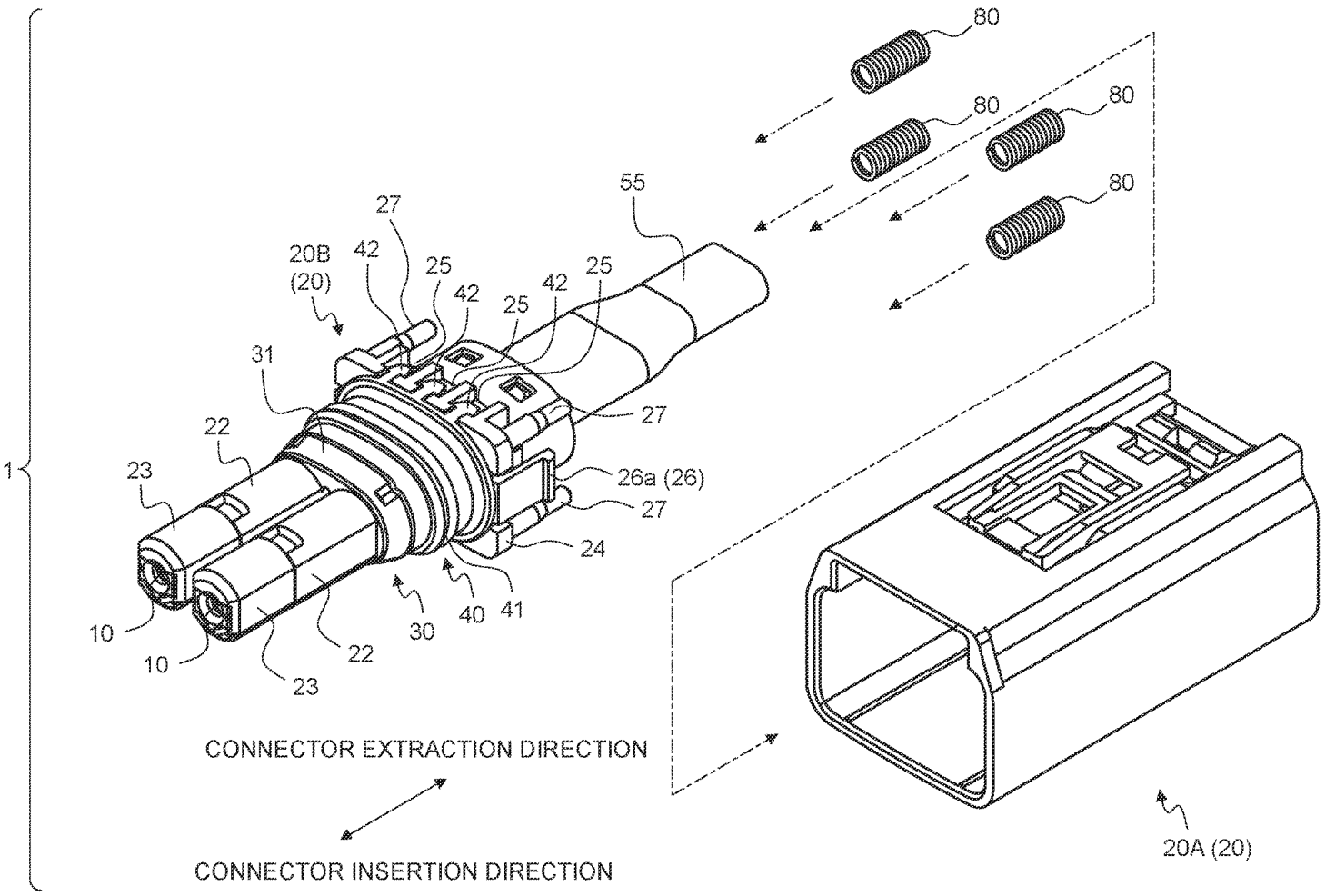
FIG. 5 is an exploded perspective view of the female connector according to the embodiment.

Specifically, the female housing 20 has a two-piece structure of an outer housing 20A and an inner housing 20B (FIG. 5).

The outer housing 20A forms the above-described hood, and is molded into a tubular shape with both ends opened. In this example, the outer housing 20A is molded into a rectangular tubular shape.

Figure 6:
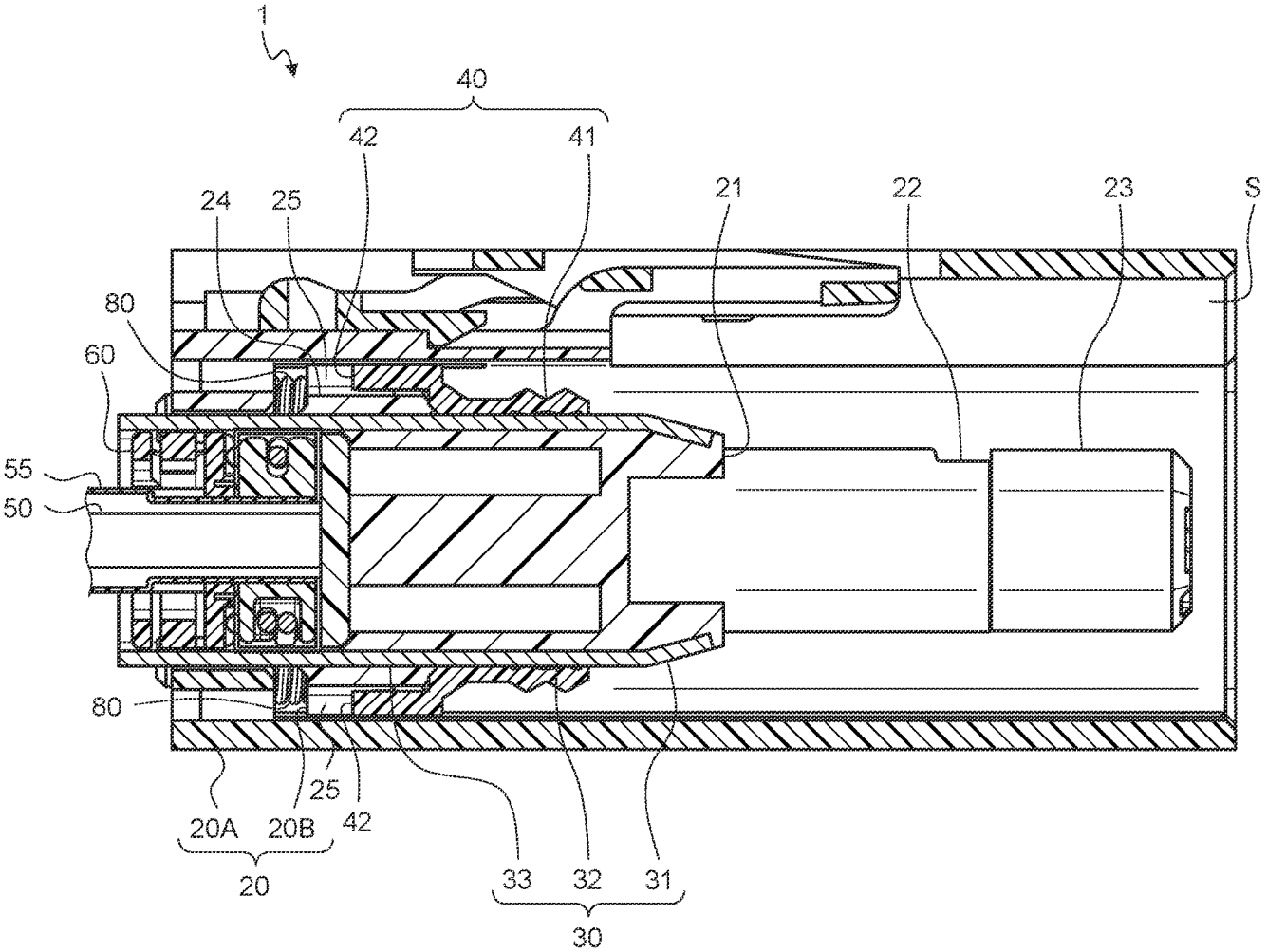
FIG. 6 is a cross-sectional view taken along a line X2-X2 of FIG. 4.
Figure 8:
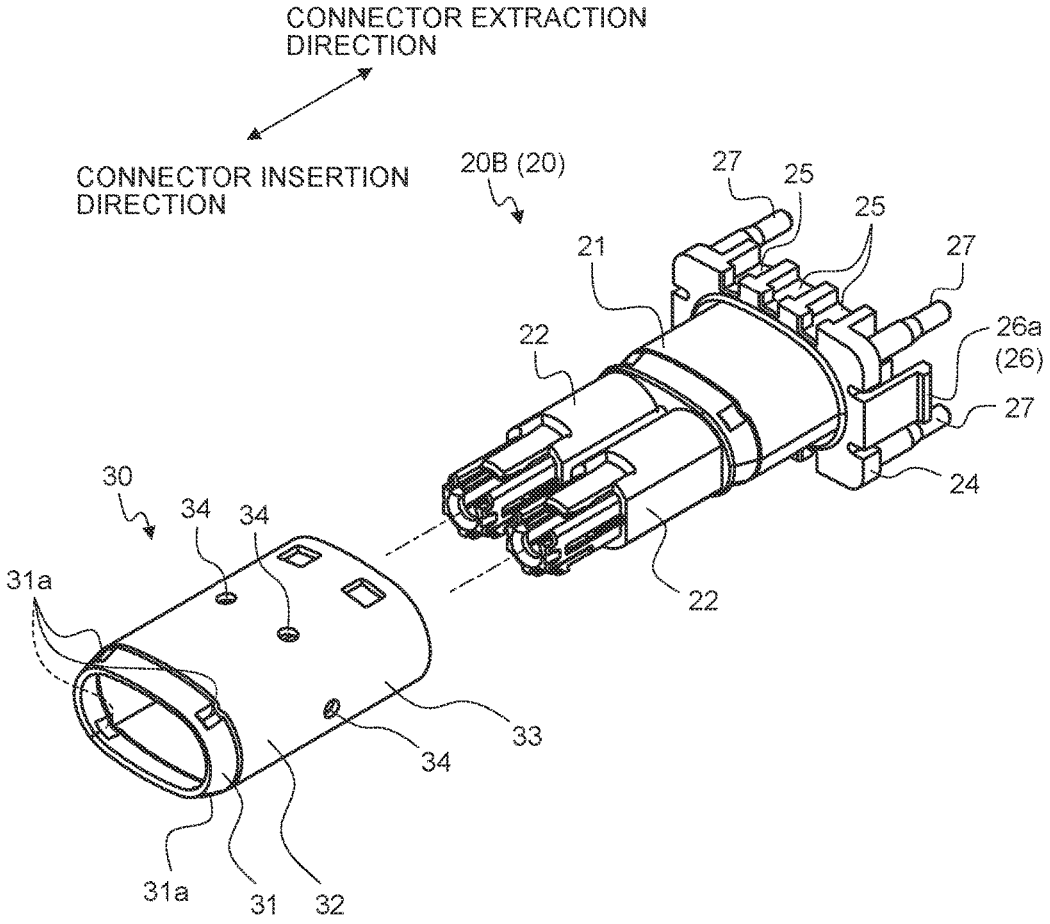
FIG. 8 is an exploded perspective view of the inner housing and the shield shell of the female connector according to the embodiment.

The inner housing 20B has a terminal accommodating section 21 in which the respective female terminals 10 are accommodated (FIGS. 6 and 8). The terminal accommodating section 21 is molded into a tubular shape in which the tubular axis direction is made to match the connector insertion and extraction direction and both ends are opened, and accommodating chambers (not illustrated) for each female terminal 10 are formed inside the terminal accommodating section 21. The terminal accommodating section 21 of this example is molded into a rectangular tubular shape. Further, in the accommodating chamber of this example, the electric wire connecting section 12 of the female terminal 10 and the terminal of the electric wire 50 connected to the electric wire connecting section 12 are accommodated.

The female terminal 10 and the electric wire 50 are inserted from the opening side of the end portion of the terminal accommodating section 21 on the connector extraction direction side (specifically, the opening at the end portion of the shield shell 30 on the connector extraction direction side). Therefore, the electric wire 50 is pulled out to the outside from the opening of the shield shell 30. The opening is closed with a shield connecting element 60 molded by an insulating material such as a synthetic resin material (FIG. 7). The shield connecting element 60 is made of at least one molded body to be fitted into the opening, and has through-holes through which the respective electric wires 50 are inserted. Further, the shield connecting element 60 holds a braid 55 made of a conductive material, and physically and electrically connects the braid 55 to the shield shell 30. The braid 55 covers the respective electric wires 50 to suppress entry of noise, and is knitted in a tubular and mesh form. A sealing member 70 is disposed on the shield connecting element 60 so as to suppress the entry of liquid from the side of the shield connecting element 60 toward the inside of the terminal accommodating section 21. The sealing member 70 is provided for each electric wire 50.

Furthermore, in the inner housing 20B, two terminal holding sections 22 as the above-described terminal holding elements are disposed side by side at the opening at the end portion of the terminal accommodating section 21 on the connector insertion direction side, for each female terminal 10 (FIGS. 7 and 8). The terminal holding sections 22 are formed into a tubular shape in which the tubular axis direction is made to match the connector insertion and extraction direction and both ends are opened, and the terminal holding sections 22 extend from the opening of the terminal accommodating section 21 along the tubular axis direction. The inside of the terminal holding section 22 communicates with the accommodating chamber of the terminal accommodating section 21 via the opening at the end portion on the connector extraction direction side. Therefore, in the terminal holding section 22 of this example, the terminal connecting section 11 is accommodated and held inside the terminal holding section 22. A tubular lid member 23 having both open ends is attached to an end portion of the terminal holding section 22 on the connector insertion direction side (FIG. 7). The male terminal 110 is inserted via the openings of the lid member 23 and the terminal holding section 22, and is inserted into the terminal connecting section 11 of the female terminal 10 with progress of the insertion. The opening of the end portion of the terminal accommodating section 21 on the connector insertion direction side is closed, except for a portion communicating with the terminal holding section 22.

Further, a tubular section 24 in which the tubular axis direction is made to match the connector insertion and extraction direction and both ends are opened is provided in the inner housing 20B (FIGS. 5, 7 and 8). The tubular section 24 is provided with a holding section 25 to hold the sealing member 40. The tubular section 24 and the holding section 25 will be described later in detail.

Figure 4:
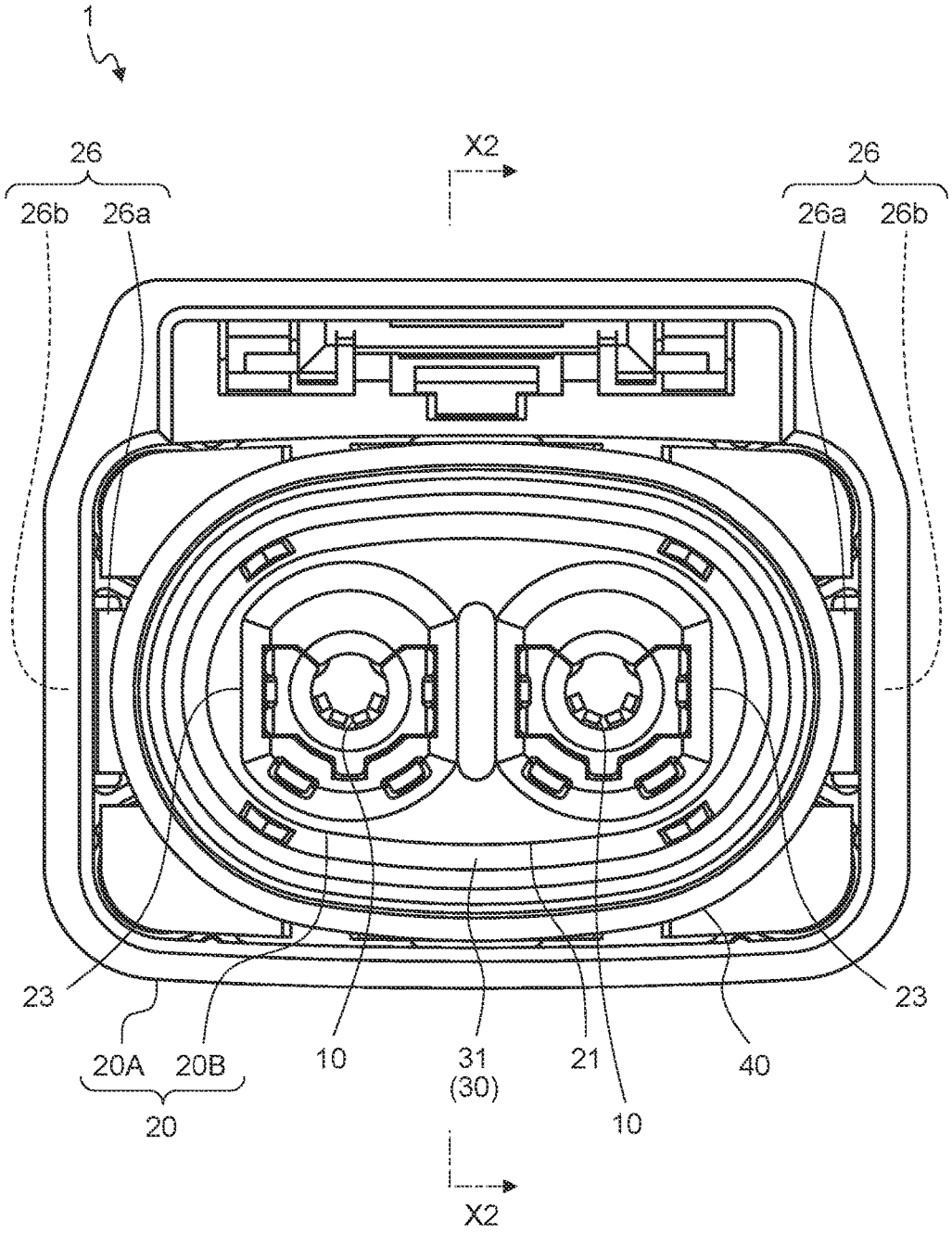
FIG. 4 is a front view of the female connector according to the embodiment as seen from an opening side.

In the female housing 20, each of the outer housing 20A and the inner housing 20B has an engaging section, and the outer housing 20A and the inner housing 20B are fixed to each other by an engaging mechanism 26 made up of respective engaging sections (FIG. 4). The inner housing 20B of this example is inserted inward with respect to the outer housing 20A along the tubular axis direction from the opening of the end portion on the connector insertion direction side. The engaging mechanism 26 engages the respective engaging sections with each other in accordance with the insertion operation, thereby integrating the outer housing 20A and the inner housing 20B. For example, in the engaging mechanism 26, one engaging section is formed into a claw shape, and the other engaging section is formed into a shape in which a claw section is caught. In the engaging mechanism 26 illustrated in FIGS. 4 and 5, a claw-shaped engaging section 26*a* is provided on the outer wall surface of the terminal accommodating section 21 of the inner housing 20B, and an engaging section 26*b* by which the claw section is caught is provided on the outer housing 20A. In FIG. 5, the engaging section 26*b* of the outer housing 20A is not illustrated. In this example, the engaging mechanisms 26 are provided in two places.

In the female housing 20, the shield shell 30 is integrated with the inner housing 20B (FIGS. 7 and 8).

The shield shell 30 is provided for countermeasures against noise, and is formed of a conductive material such as metal in a tubular shape in which the tubular axis direction is made to match the connector insertion and extraction direction and both ends are opened (FIG. 8). Since the shield shell 30 is integrated with the terminal accommodating section 21 or the like of the inner housing 20B, the shield shell 30 is molded into a rectangular tubular shape in accordance with the shape of the terminal accommodating section 21. Further, the shield shell 30 is physically and electrically connected to the shield shell 130 of the male connector 2 after complete fitting with the male connector 2.

The shield shell 30 is integrated with the inner housing 20B in a state in which at least one of the outer circumferential side and the inner circumferential side of the end portion on the connector insertion direction side is exposed as an annular exposed surface. At least a surface used as a contact portion between the shield shell 30 and the shield shell 130 of the male connector 2 (hereinafter, referred to as an "electrical connection surface") is provided as the exposed surface. The electrical connection surface is a portion corresponding to the aforementioned abutment section. In the shield shell 30 of this example, the end portion on the connector insertion direction side is formed into a tapered shape, and a tapered surface (first tapered surface) 31 on the outer circumferential side thereof is used as the electrical connection surface. The first tapered surface 31 is inclined so that the size of the outer circumferential edge of the cross-section orthogonal to the connector insertion and extraction direction on the outer circumferential surface of the tapered portion decreases toward the connector insertion direction. In the shield shell 30 of this example, the outer circumferential surface on the connector extraction direction side of the first tapered surface 31 is also exposed from the inner housing 20B, and this annular exposed surface is used as a seal side exposed surface 32. In the shield shell 30 of this example, the end portion on the connector insertion direction side narrows inward with respect to the seal side exposed surface 32. Therefore, the first tapered surface 31 is provided on the inner side than the seal side exposed surface 32.

Here, in the first tapered surface 31, its annular wall surface may be set as a contact or at least one protruding portion protruding from the annular wall surface may be set as a contact. The first tapered surface 31 in this example is provided with four protruding portions 31*a* (FIGS. 7 and 8), which are used as contacts.

The shield shell 30 of this example is disposed so that a first tapered surface 31 and a seal side exposed surface 32 are provided on the outer circumferential surface, and the outer circumferential surface of the terminal accommodating section 21 is covered with the inner circumferential surface of the shield shell 30. The shield shell 30 is integrated with the terminal accommodating section 21 in the state of bringing the inner circumferential surface of the shield shell 30 into contact with the outer circumferential surface of the terminal accommodating section 21. In the female connector 1, the integration of the inner housing 20B and the shield shell 30 may be performed by fitting each other, or may be performed by insert molding of the inner housing 20B with respect to the shield shell 30. In this example, insert molding is used.

The female terminal 10 and/or the electric wire 50 is disposed in a state of being inserted through the inside of the shield shell 30, and the shield shell 30 suppresses the entry of noise into the female terminal 10 and/or the electric wire 50. According to a positional relation of the shield shell 30 of this example to the terminal accommodating section 21, the electric wire connecting section 12 of the female terminal 10, and the terminal of the electric wire 50 connected to the electric wire connecting section 12 are accommodated inside the shield shell 30.

The shield shell 30 has an annular connecting wall surface 33 connected to the seal side exposed surface 32 on the connector extraction direction side (FIGS. 6 and 8). The tubular section 24 of the inner housing 20B illustrated above is brought into contact with the connecting wall surface 33 along the circumferential direction. Therefore, the tubular section 24 is molded into a rectangular tubular shape. In this example, the seal side exposed surface 32 is provided on the outer circumferential surface of the shield shell 30, and the connecting wall surface 33 is provided on the same outer circumferential surface. Thus, the tubular section 24 is disposed on the outer side of the shield shell 30. That is, the shield shell 30 in this example is interposed between the terminal accommodating section 21 on the inside and the tubular section 24 on the outside in a direction orthogonal to the tubular axis direction. As described above, the inner housing 20B of this example is integrated with the shield shell 30 by insert molding. At the time of the insert molding, the synthetic resin material injected to form the inner housing 20B is filled to the inside and the outside of the shield shell 30, for example, via a through-hole 34 (FIG. 8) provided in the shield shell 30, and forms the terminal accommodating section 21 and the tubular section 24, respectively.

The sealing member 40 is used to suppress the entry of liquid into the contact portion between the shield shells 30 and 130 in the female connector 1 and the male connector 2 fitted to each other. Therefore, the sealing member 40 has a tubular sealing section 41 interposed between the inner housing 20B or the shield shell 30 and the male housing 120 or the shield shell 130 (FIGS. 6 and 7). The sealing section 41 of this example brings the inner circumferential surface side into close contact with the seal side exposed surface 32 of the shield shell 30, and brings the outer circumferential surface side into close contact with the inner circumferential surface of the male housing 120, thereby preventing the liquid from entering the contact portion between the shield shells 30 and 130.

The sealing member 40 is held by the inner housing 20B. For this reason, the inner housing 20B is provided with the holding section 25 as illustrated above (FIG. 7). The holding section 25 is provided on a wall surface on the side orthogonal to the tubular axis direction of the tubular section 24 and on the side opposite to the side facing the connecting wall surface 33 of the shield shell 30. In this example, three holding sections 25 are provided at positions facing each other in a direction orthogonal to the connector insertion and extraction direction. Meanwhile, the sealing member 40 is provided with a holding target section 42 held by the holding section 25 (FIGS. 5, 6, and 7). The holding target section 42 of this example is disposed in accordance with the positions of each holding section 25. In this example, the holding target section 42 is held by the holding section 25, by fitting the holding target section 42 to the holding section 25 formed as a space or a groove.

In the female connector 1 of this example, a tubular space S, in which an end portion on the connector insertion direction side is opened, is formed between the outer housing 20A, the inner housing 20B and the shield shell 30 (FIG. 6). The male connector 2 is fitted into the female connector 1, while being inserted into the tubular space S from the opening. The space S of this example is formed into a rectangular tubular shape.

The male connector 2 of this example includes a male terminal 110, a male housing 120 and a shield shell 130, as previously indicated.

The male housing 120 has a terminal accommodating section 121 and a terminal holding section 122 (FIGS. 9 to 12).

Figure 9:
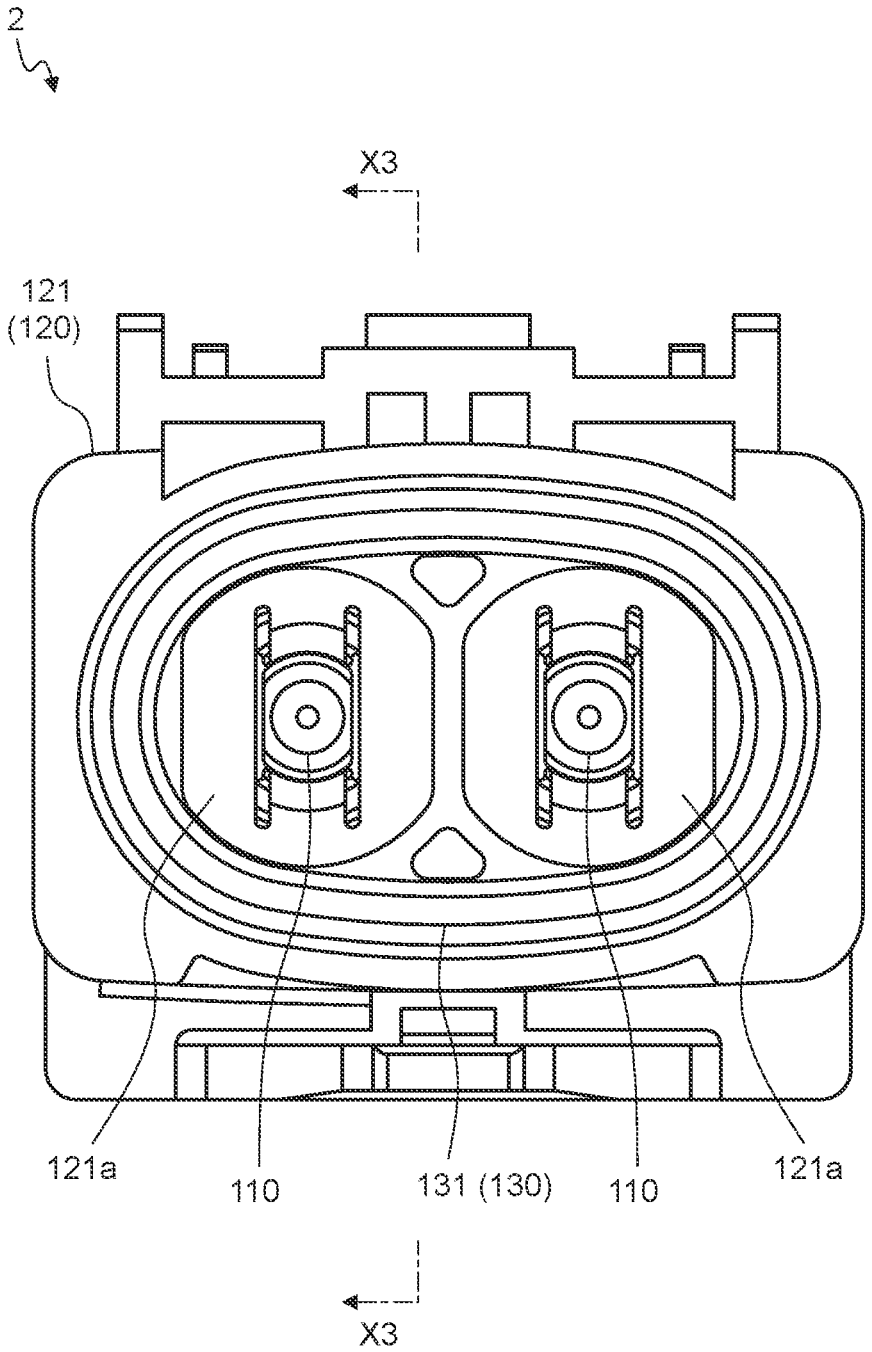
FIG. 9 is a front view of the male connector according to the embodiment as seen from an opening side.

The terminal accommodating section 121 is molded into a tubular shape in which the tubular axis direction is made to match the connector insertion and extraction direction and both ends are opened, and accommodating chambers 121*a* for each of the male terminals 110 are formed inside the terminal accommodating section 121 (FIG. 9). A terminal connecting section 111 of the male terminal 110 is accommodated in the accommodating chamber 121*a*. An end portion of the terminal accommodating section 121 on the connector insertion direction side also serves as a part (a hood section) of the hood, and is inserted into a rectangular tubular space S of the female connector 1. For this reason, the terminal accommodating section 121 of this example is molded into a rectangular tubular shape made to match the shape of the space S. The outer circumferential surface side on the sealing section 41 of the sealing member 40 is brought into close contact with the inner circumferential surface of the hood section after the connector is fitted.

The terminal holding section 122 is molded into a tubular shape in which the tubular axis direction is made to match the connector insertion and extraction direction and both ends are opened, and the terminal holding section 122 is disposed in the opening at the end portion of the terminal accommodating section 121 on the connector extraction direction side.

A accommodating chamber (not illustrated) for each male terminal 110 is formed inside the terminal holding section 122, and the electric wire connecting section 112 of the male terminal 110, and the terminal of the electric wire 150 connected to the electric wire connecting section 112 are accommodated in the accommodating chamber. A holding target section 113 (FIG. 11) of the male terminal 110 is fitted in the accommodating chamber and is held with the fitting.

The shield shell 130 is provided for countermeasures against noise, and is formed of a conductive material such as metal in a tubular shape in which the tubular axis direction is made to match the connector insertion and extraction direction side and both ends are opened (FIGS. 9 to 12). Since the shield shell 130 is integrated with the male housing 120, the shield shell 130 is molded into a rectangular tubular shape in accordance with the shape of the male housing 120.

The shield shell 130 is disposed inside the male housing 120, and an end portion of the shield shell 130 on the connector extraction direction side protrudes from the male housing 120. The male terminal 110 and/or the electric wire 150 are disposed inside the illustrated shield shell 130 in the inserted state to suppress noise from entering the male terminal 110 and/or the electric wire 150. The male terminal 110 and the terminal of the electric wire 150 are accommodated inside the shield shell 130 of this example. Thus, the male housing 120 is formed so that the accommodating chamber 121*a* of the terminal accommodating section 121 and the accommodating chamber of the terminal holding section 122 are disposed inside the shield shell 130, and so that the outer tubular circumferential sides of each of the terminal accommodating section 121 and the terminal holding section 122 are disposed outside the shield shell 130. In this example, by integrating the male housing 120 and the shield shell 130, the mutual arrangement of the male housing 120 and the shield shell 130 is attained. In the male connector 2, the male housing 120 and the shield shell 130 may be integrated by fitting or the like, or may be integrated by insert molding of the male housing 120 with respect to the shield shell 130.

Figure 10:
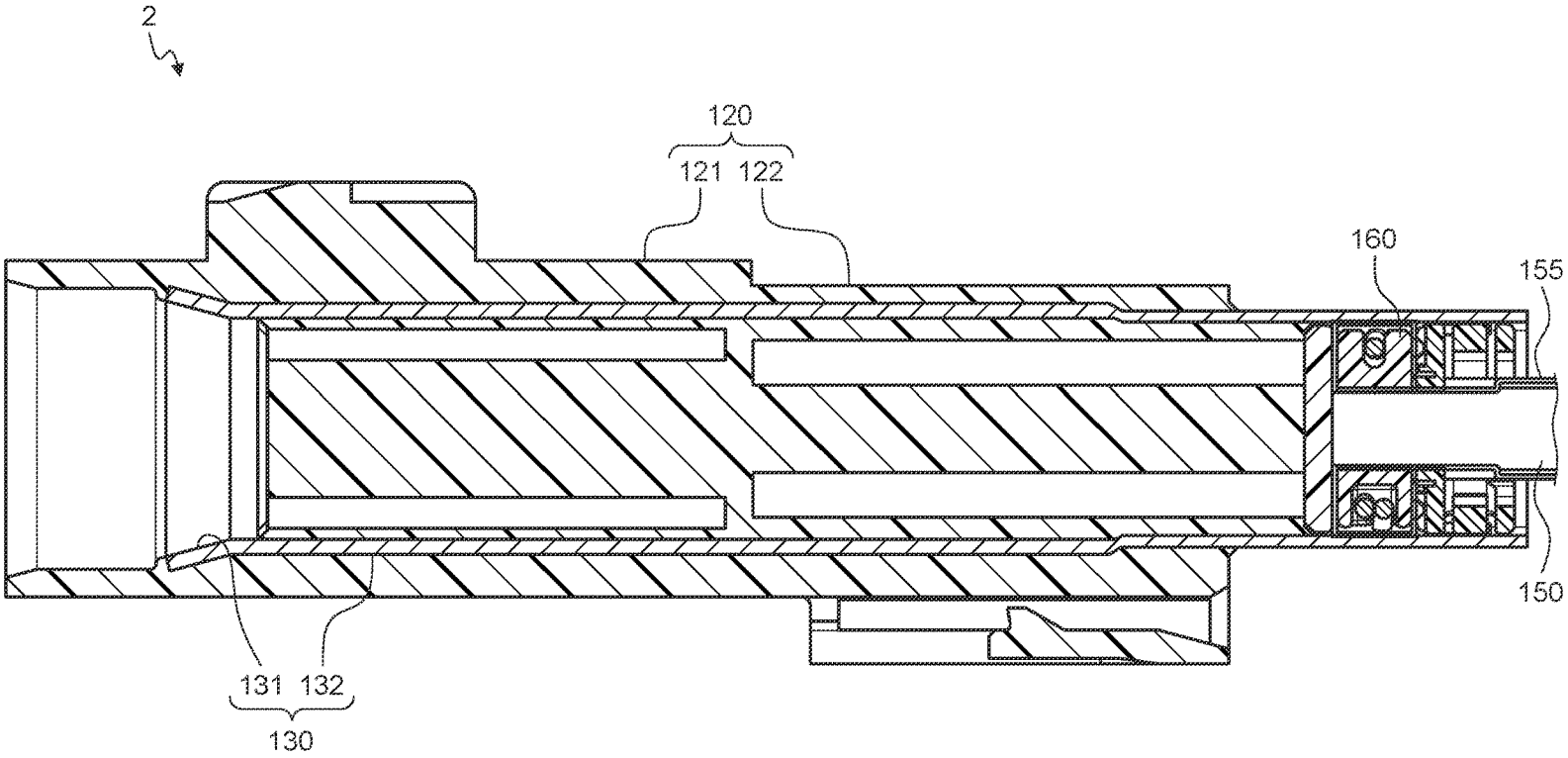
FIG. 10 is a cross-sectional view taken along a line X3-X3 of FIG. 9.
Figure 12:
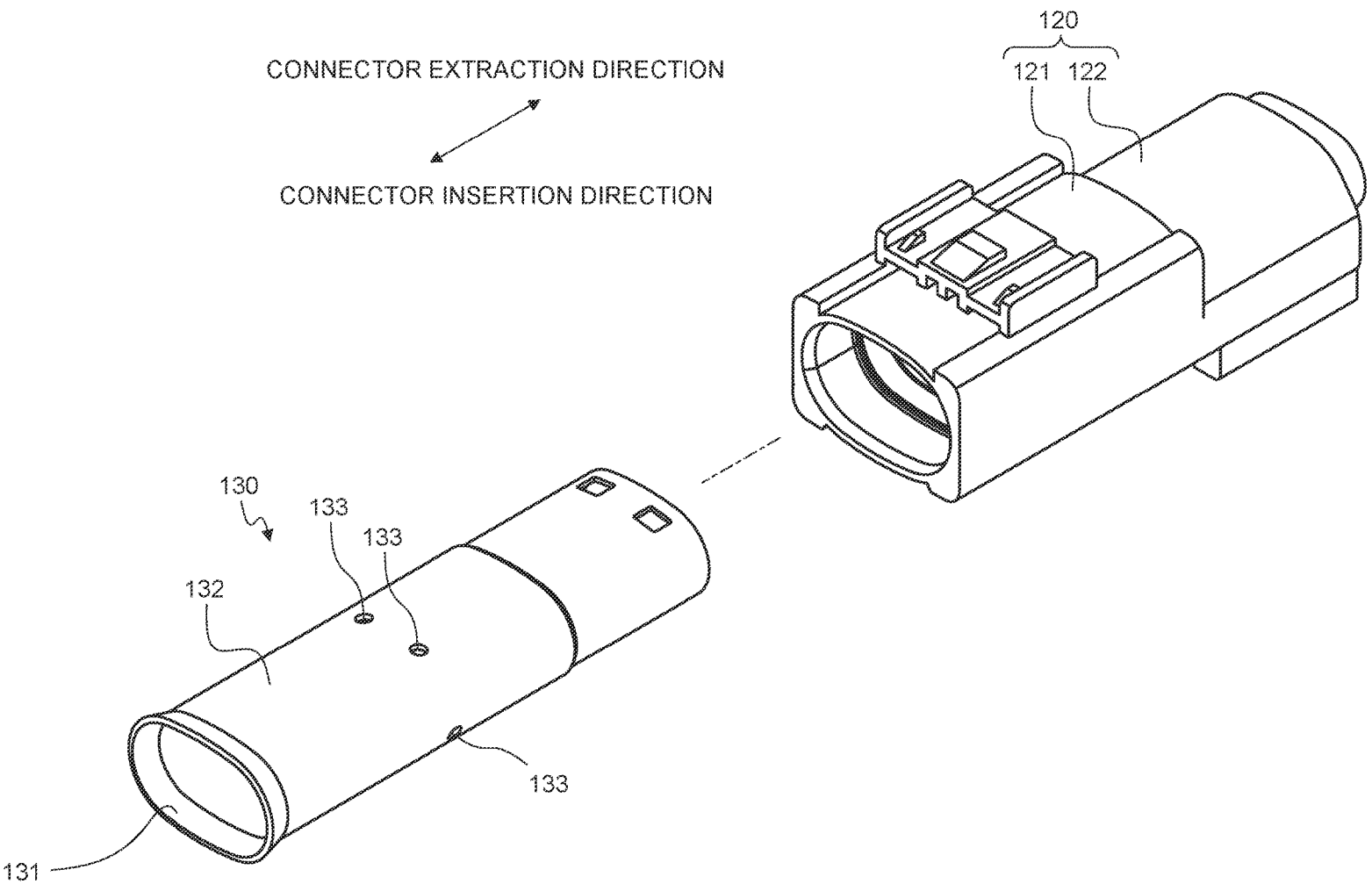
FIG. 12 is an exploded perspective view of a housing and a shield shell of the male connector of the embodiment.

Here, the shield shell 130 is integrated with the male housing 120 in a state in which at least one of the outer circumferential side and the inner circumferential side of the end portion on the connector insertion direction side is exposed as an annular exposed surface. At least the electrical connection surface is provided as the exposed surface. The electrical connection surface is a part that is physically and electrically connected to the electrical connection surface (the first tapered surface 31) of the shield shell 30 of the female connector 1. In the shield shell 130 of this example, an end portion on the connector insertion direction side is formed into a tapered shape, and a tapered surface (a second tapered surface) 131 on the inner circumferential side of the end portion is used as an electrical connection surface (FIGS. 10 to 12). The second tapered surface 131 is inclined so that the size of the inner circumferential edge of the cross-section orthogonal to the connector insertion and extraction direction on the inner circumferential surface of the tapered portion increases toward the connector insertion direction. In the second tapered surface 131, an annular wall surface may be used as a contact, and at least one protruding portion protruding from the annular wall surface may be used as a contact. The annular wall surface of the second tapered surface 131 in this example is used as a contact. In the shield shell 130 of this example, the end portion on the connector insertion direction side gradually expands outward with respect to the inner circumferential surface of a main body portion 132 forming the major part of the shield shell 130. Therefore, the second tapered surface 131 is provided on the outer side than the inner circumferential surface of the main body portion 132.

The male housing 120 of this example is integrated with the shield shell 130 by the insert molding. At the time of the insert molding, the synthetic resin material injected to form the male housing 120 is filled into the inside and the outside of the shield shell 130, for example, via a through-hole 133 (FIG. 12) provided in the shield shell 130. The synthetic resin material filled to the inside of the shield shell 130 forms the accommodating chamber 121*a* side of the terminal accommodating section 121, and an accommodating chamber side of the terminal holding section 122. Meanwhile, the synthetic resin material filled to the outside of the shield shell 130 forms a tubular outer circumferential side of each of the terminal accommodating section 121 and the terminal holding section 122.

The male terminal 110 and the electric wire 150 are inserted from the opening side of the end portion of the shield shell 130 on the connector extraction direction side (specifically, the opening at the end portion of the shield shell 130 on the connector extraction direction side). Therefore, the electric wire 150 is pulled out to the outside from the opening of the shield shell 130. The opening is closed with a shield connecting element 160 molded by an insulating material such as a synthetic resin material (FIG. 11). The shield connecting element 160 is made of at least one molded body to be fitted to the opening, and has a through-hole through which the respective electric wires 150 are inserted. Further, the shield connecting element 160 holds a braid 155 made of a conductive material, and physically and electrically connects the braid 155 to the shield shell 130. The braid 155 covers the respective electric wires 150 to suppress entry of noise and is knitted in a tubular and mesh form. A sealing member 170 is disposed on the shield connecting element 160 to suppress the entry of liquid from the side of the shield connecting element 160 toward the inside of the terminal accommodating section 121. The sealing member 170 is provided for each electric wire 150.

In the female and male connectors, by causing the first tapered surface 31 side and the second tapered surface 131 side to abut against each other in the connector insertion direction with the insertion of the connector, the respective shield shells 30 and 130 are physically and electrically connected to each other. In this example, the four protruding portions 31*a* of the first tapered surface 31 are made to protrude toward the second tapered surface 131 as an abutting target, and the protruding portion 31*a* thereof is brought into contact with the second tapered surface 131. Therefore, the first tapered surface 31 and the second tapered surface 131 are formed to be substantially parallel to each other (in other words, to have substantially the same inclination angle).

Incidentally, in the female and male connectors, in order to maintain the abutting state between the first tapered surface 31 side and the second tapered surface 131 side after the connector fitting, a holding mechanism to hold the abutting state is provided. Further, in the female and male connectors, an occurrence of rattling after connector fitting between the female connector 1 and the male connector 2 is also suppressed, using the holding mechanism.

In the female and male connectors, in order to provide a holding mechanism which also serves as the rattling suppression mechanism, in the female connector 1, the outer housing 20A and the inner housing 20B are configured to be movable relative to each other in the connector insertion and extraction direction. A guide mechanism (not illustrated) may be provided between the outer housing 20A and the inner housing 20B to regulate the direction of the relative movement.

Furthermore, in the female connector 1, an elastic member 80 is disposed between the outer housing 20A and the inner housing 20B (FIG. 5) to exert a resilient force on the inner housing 20B after the connector fitting toward the male connector 2 in the connector insertion direction. In this example, one shaft 27 protruding in the connector extraction direction is provided at each of the four corners of the rectangular tubular section 24 of the inner housing 20B. Further, a helical spring, into which the shaft 27 is inserted, is provided to each of the four corners one by one as the elastic member 80. The elastic member 80 expands and contracts relatively with respect to the shaft 27 in the connector insertion and extraction direction.

The elastic member 80 is configured so that one end thereof on the connector insertion direction side is locked to the tubular section 24 at the latest after the connector fitting (that is, at the latest after the first tapered surface 31 side and the second tapered surface 131 side are abutted each other), the other end thereof on the connector extraction direction side is locked to the inner wall surface of the outer housing 20A, and the elastic member 80 is compressed between the outer housing 20A and the inner housing 20B. Therefore, in the female and male connectors, after the connector fitting, by the resilient force of the elastic member 80 generated when the second tapered surface 131 side presses the first tapered surface 31 side, the first tapered surface 31 side is pressed against the second tapered surface 131. Accordingly, it is possible to maintain the abutted state between the first tapered surface 31 side and the second tapered surface 131 side after the connectors are fitted. Furthermore, in the female and male connectors, it is possible to suppress an occurrence of rattling between the shield shells 30 and 130 in the connector insertion and extraction direction and in the direction orthogonal to the connector insertion and extraction direction, with the maintenance of the abutted state between the shield shells 30 and 130. Accordingly, it is possible to suppress an occurrence of rattling in the same direction between the female connector 1 and the male connector 2.

As described above, the female and male connectors of this embodiment have a structure in which the respective shield shells 30 and 130 are made to abut against each other (in this example, the first tapered surface 31 side and the second tapered surface 131 side are made to abut against each other), and do not involve the sliding movement between the shield shells 30 and 130 when fitting the connector as in the prior art. Accordingly, it is possible to reduce the insertion force at the time of the connector fitting. Also, at the time of detachment between the female connector 1 and the male connector 2, since the female and male connectors do not involve the sliding movement between the shield shells 30 and 130, the extraction force is reduced. In this way, in the female and male connectors, it is possible to reduce the insertion and extraction force at the time of insertion and extraction of the connectors. Therefore, in the female and male connectors, since it is not necessary to provide a lever mechanism which assists the insertion and extraction force as in the related art, it is possible to reduce the number of parts, the cost, and the downsizing of the body.

Furthermore, since the female and male connectors do not involve the sliding movement between the shield shells 30 and 130, even if inexpensive plating (tin plating or the like) is applied to the first tapered surface 31 side and the second tapered surface 131 side, peeling of the plating can be suppressed, and the electrical connection state between the shield shells 30 and 130 can be maintained. Therefore, in the female and male connectors, it is possible to reduce the cost required for the plating.

Further, the female and male connectors also include a holding mechanism of the abutted state between the shield shells 30 and 130 also serving as a rattling suppression mechanism between the female connector 1 and the male connector 2. Therefore, even when an external force such as vibration is input, since the fitted state of the connector is maintained in a designed state, the female and male connectors can hold the electrical connection state between the female terminal 10 and the male terminal 110 and between the shield shells 30 and 130, respectively. Therefore, the female and male connectors can maintain the original function of the connectors to electrically connect male member and female member, and the female and male connectors can ensure the shielding performance of the shield shells 30 and 130.

Modified Example

In the female and male connectors of the above-described embodiment, the respective shield shells of the female connector and the male connector have tapered surfaces at their end portion on the connector insertion direction side, and the tapered surfaces are made to abut against each other by utilizing the resilient force of the elastic members. Therefore, in each of the shield shells, such a tapered surface is provided after securing a minimum arrangement space of terminals, electric wires and the like disposed inside. Therefore, in the shield shell having the outer circumferential surface as the tapered surface (the first tapered surface 31) such as the shield shell 30, the size of the inner circumferential edge formed by the end surface of the shield shell in the connector insertion direction needs to be secured to be equal to or higher than the minimum arrangement space (a minimum space required for the arrangement of the terminal or the like). Therefore, from the viewpoint of the size of the body in the radial direction, there is a room for miniaturization of the female and male connectors.

The female and male connectors of this modified example are capable of reducing the size of the body in the radial direction as compared with the female and male connectors of the embodiment, while obtaining the same effect as the female and male connectors of the embodiment. As in the above-described embodiment, the female and male connectors include a first connector and a second connector of one of female and male connectors fitted to each other, and each of the first connector and the second connector includes a tubular shield shell. One of the shield shells is formed to have a tapered surface inclined to the connector insertion and extraction direction at the end portion of the shield shell on the connector insertion direction side. In contrast, the other of the respective shield shells is formed to have at least one protruding portion protruding toward the counterpart tapered surface at the end portion of the shield shell on the connector insertion direction side. Each of the shield shells is formed such that the tapered surface and the protruding portion abut against each other with the insertion of the connectors. In this way, in the female and male connectors of this modified example, only one of the shield shells may have a tapered surface, and thus, it is possible to reduce the size of the body in the radial direction. Hereinafter, an example of the female and male connectors of this modified example will be specifically described.

Figure 13:
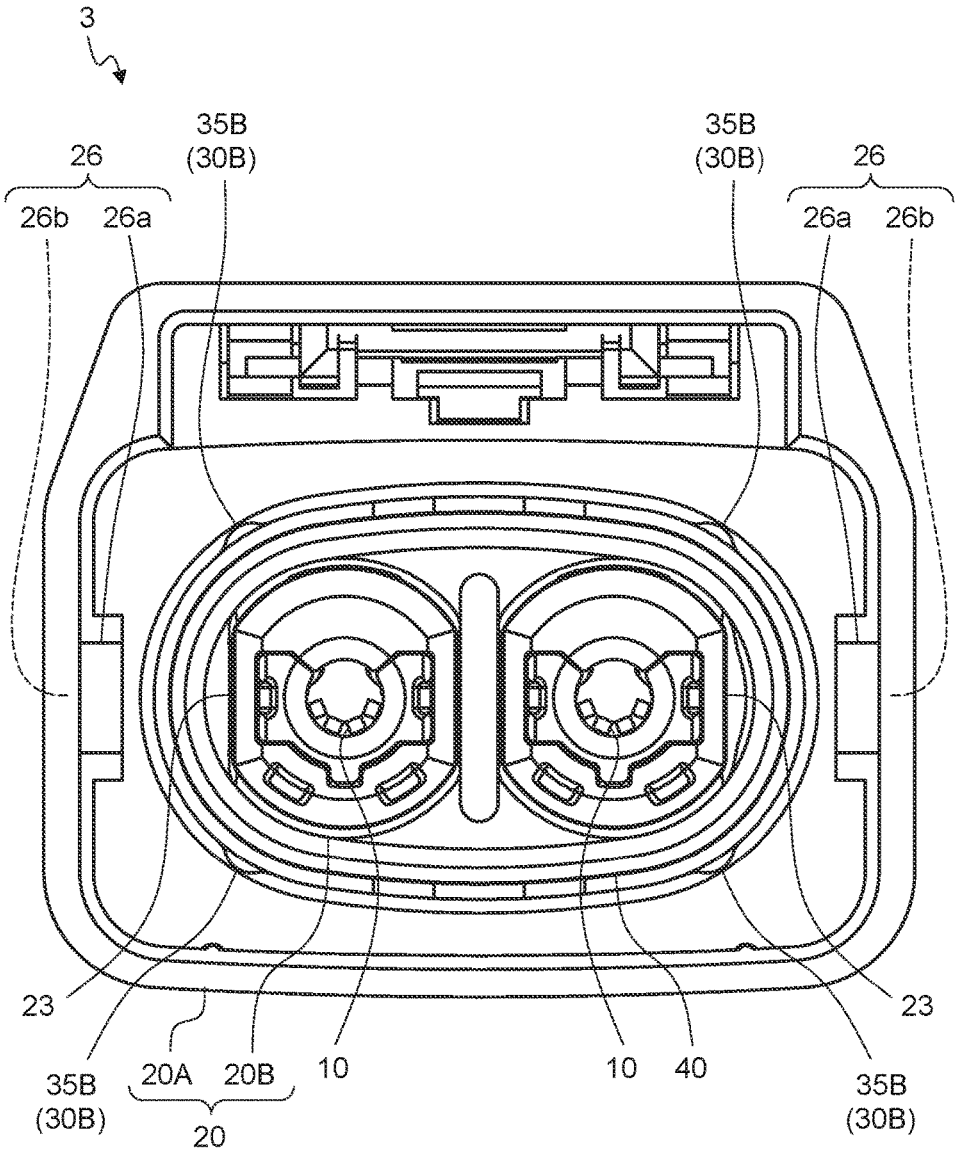
FIG. 13 is a front view of a female connector of a modified example as seen from the opening side.
Figure 14:
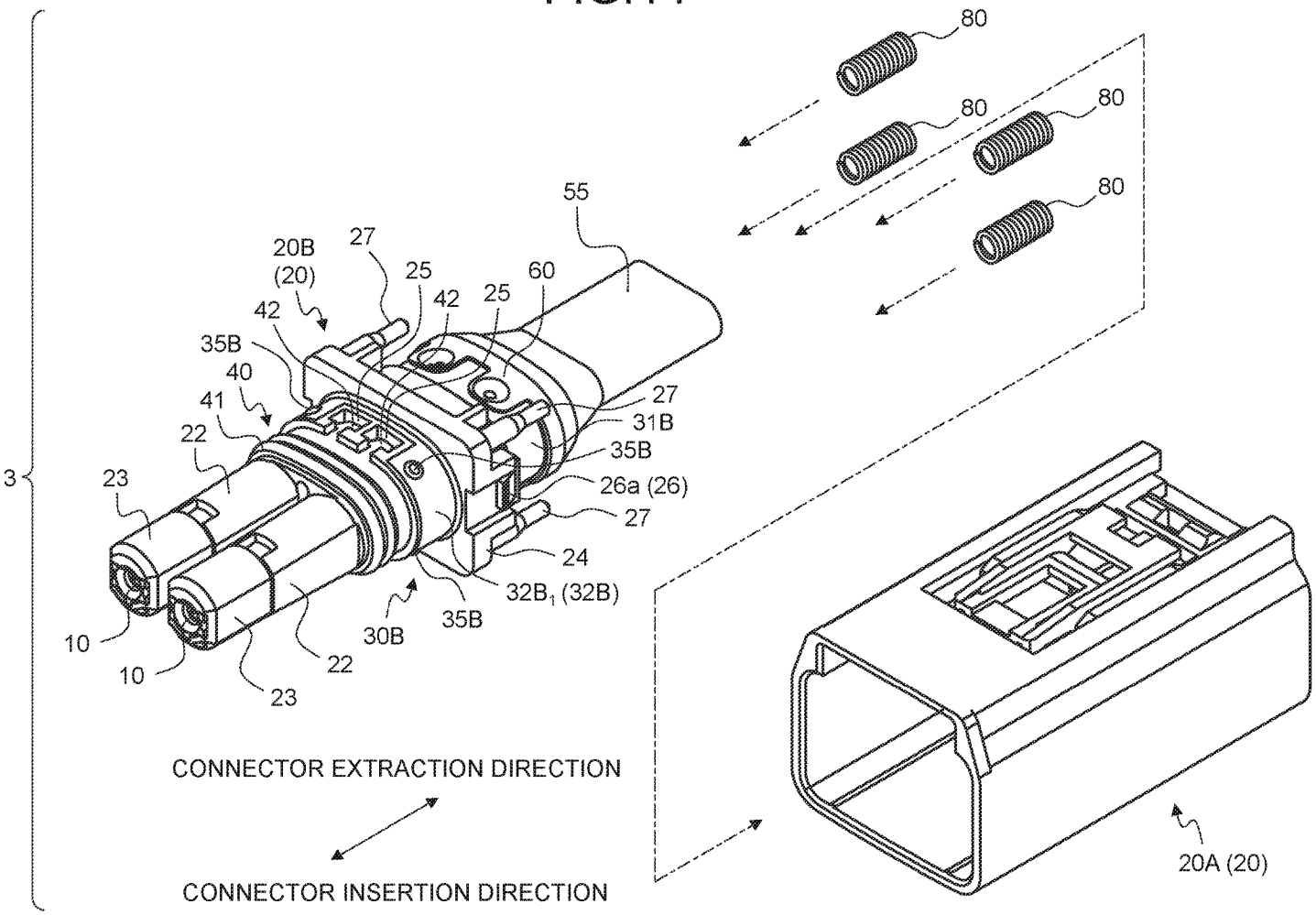
FIG. 14 is an exploded perspective view of a female connector of a modified example.

Reference numeral 3 in FIGS. 13 and 14 illustrates a female connector in the female and male connectors of this modified example. Although there are some differences in shape and arrangement, the female connector 3 of this modified example is made up of the same components as the female connector 1 of the embodiment. Therefore, except for the component (a shield shell 30B) which is the main point of this modified example, the same reference numerals as those in the embodiment are denoted and the description thereof will not be provided.

The female connector 3 includes two terminals (female terminals) 10 arranged in the same direction, a female housing 20 having a two-piece structure of an outer housing 20A and an inner housing 20B, a shield shell 30B integrated with the female housing 20 (the inner housing 20B) by insert molding or the like, and a sealing member 40. The female connector 3 is configured so that the resilient force of the elastic member 80 toward the counterpart shield shell 130B to be described later acts on the shield shell 30B (FIG. 14).

Figure 15:
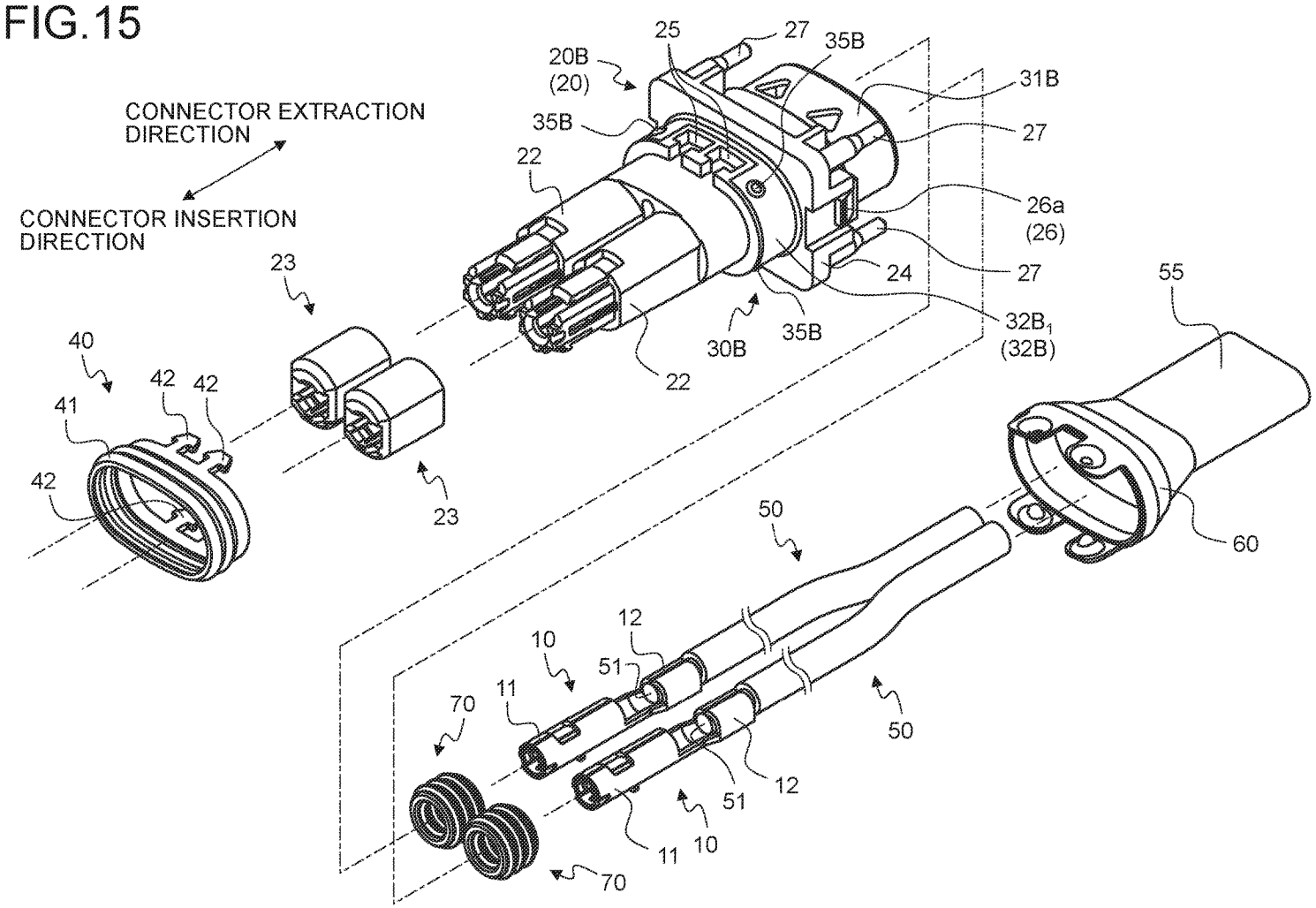
FIG. 15 is an exploded perspective view of internal components of a female connector of a modified example.
Figure 16:
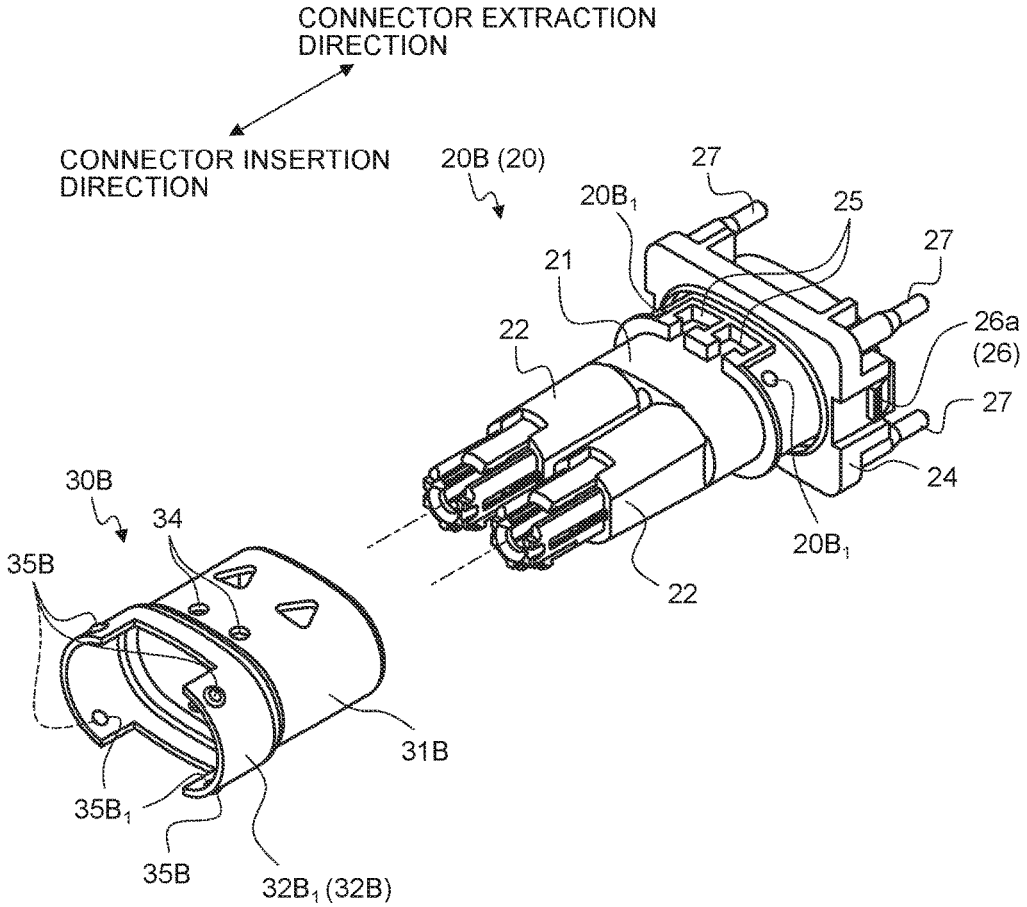
FIG. 16 is an exploded perspective view of an inner housing and a shield shell of a female connector of a modified example.

As in the shield shell 30 of the embodiment, the shield shell 30B is molded into a rectangular tubular shape, and the electric wire connecting section 12 of the female terminal 10 and the terminal of the electric wire 50 are disposed inside the shield shell 30B in the inserted state (FIG. 15). The shield shell 30B has a rectangular tubular main body portion 31B, and a rectangular tubular end portion 32B provided on the connector insertion direction side of the main body portion 31B (FIG. 16). The shield shell 30B is integrated with the inner housing 20B in a state in which the outer circumferential side of the end portion 32B is exposed as an annular exposed surface 32$B_1$ (FIGS. 15 and 16).

However, its end portion 32B extends toward the connector insertion direction side along the connector insertion and extraction direction, and does not have a tapered shape as in the shield shell 30 of the embodiment.

In the shield shell 30B, although the annular exposed surface 32$B_1$ corresponds to the electrical connection surface of the shield shell 30 of the embodiment, the exposed surface 32$B_1$ does not directly abut against the shield shell 130B, and protruding portions 35B such as a plurality of indents or the like provided on the exposed surface 32$B_1$ (FIGS. 13 to 16) abut against the shield shell 130B. The protruding portion 35B is a part that is made to protrude outward in the radial direction from the exposed surface 32$B_1$, and is formed to abut against a tapered surface 132$B_1$ to be described later of the shield shell 130B after the female connector 3 and a male connector 4 are completely fitted together. The protruding portion 35B of this example is provided at each of the four corners of the exposed surface 32$B_1$.

Here, the protruding portion 35B of this example is pressed to the outer circumferential surface side from the inner circumferential surface side of the shield shell 30B, and a recess 35$B_1$ is provided on the inner circumferential surface side thereof (FIG. 16). When the inner housing 20B is molded integrally with the shield shell 30B, the synthetic resin material is caused to flow into the recess 35$B_1$ on the inner circumferential surface side on the protruding portion 35B. In the inner housing 20B, a protruding portion 20$B_1$ corresponding to the shape of the recess 35$B_1$ is formed by the synthetic resin material in the recess 35$B_1$ (FIG. 16). Therefore, in the female connector 3, it is possible to improve the joining strength between the shield shell 30B and the inner housing 20B by the protruding portion 20$B_1$ in the recess 35$B_1$.

In order to enable the arrangement of the electric wire connecting section 12 of the female terminal 10 and the terminal of the electric wire 50 inside the shield shell 30B, the sizes of the internal spaces of each of the main body portion 31B and the end portion 32B are set. By reducing the size of the inner circumferential edge of the cross-section orthogonal to the connector insertion and extraction direction within a range in which the electric wire connecting section 12 and the like can be disposed, the shield shell 30B can be reduced in size in the radial direction. In particular, since the end portion 32B of the shield shell 30B does not have a tapered shape as in the shield shell 30 of the embodiment and extends along the connector insertion and extraction direction, it is possible to reduce the size of the shield shell 30B in the radial direction as compared with the shield shell 30.

Further, in the female connector 3, the sealing member 40 is disposed on the connector insertion direction side from the end surface of the shield shell 30B on the connector insertion direction side.

Figure 17:
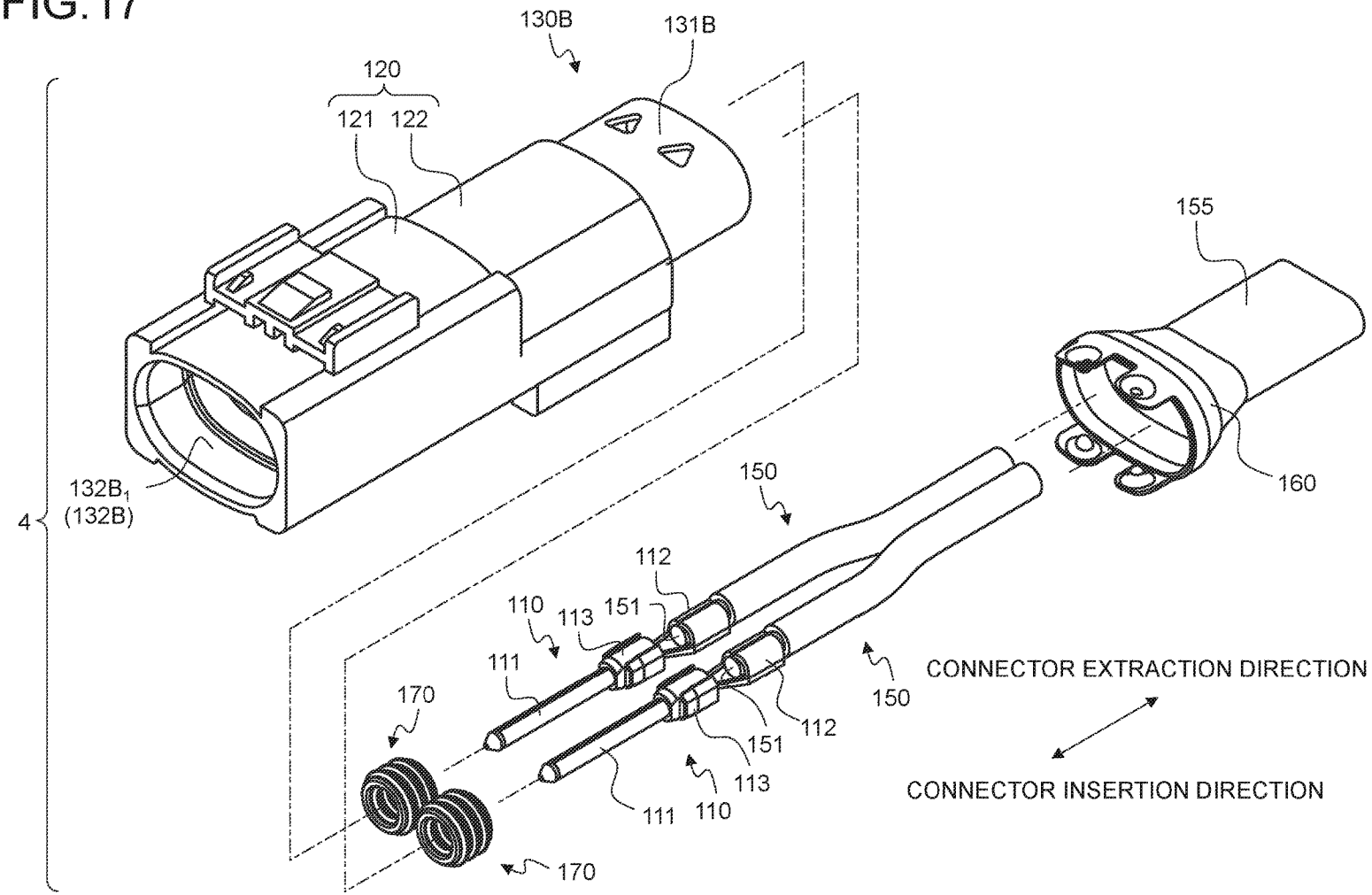
FIG. 17 is an exploded perspective view of a male connector of a modified example.

Reference numeral 4 of FIG. 17 illustrates the male connector in the female and male connectors of this modified example. Although there are some differences in shape and arrangement, the male connector 4 of this modified example is made up of the same components as the male connector 2 of the embodiment. Therefore, except for the component (shield shell 130B) which is the main points of this modified example, the same reference numerals as those in the embodiment are denoted and the description thereof will not be provided.

The male connector 4 includes two terminals (male terminals) 110 arranged in the same direction, a male housing 120, and a shield shell 130B integrated with the male housing 120 by insert molding or the like (see FIG. 17).

Figure 18:
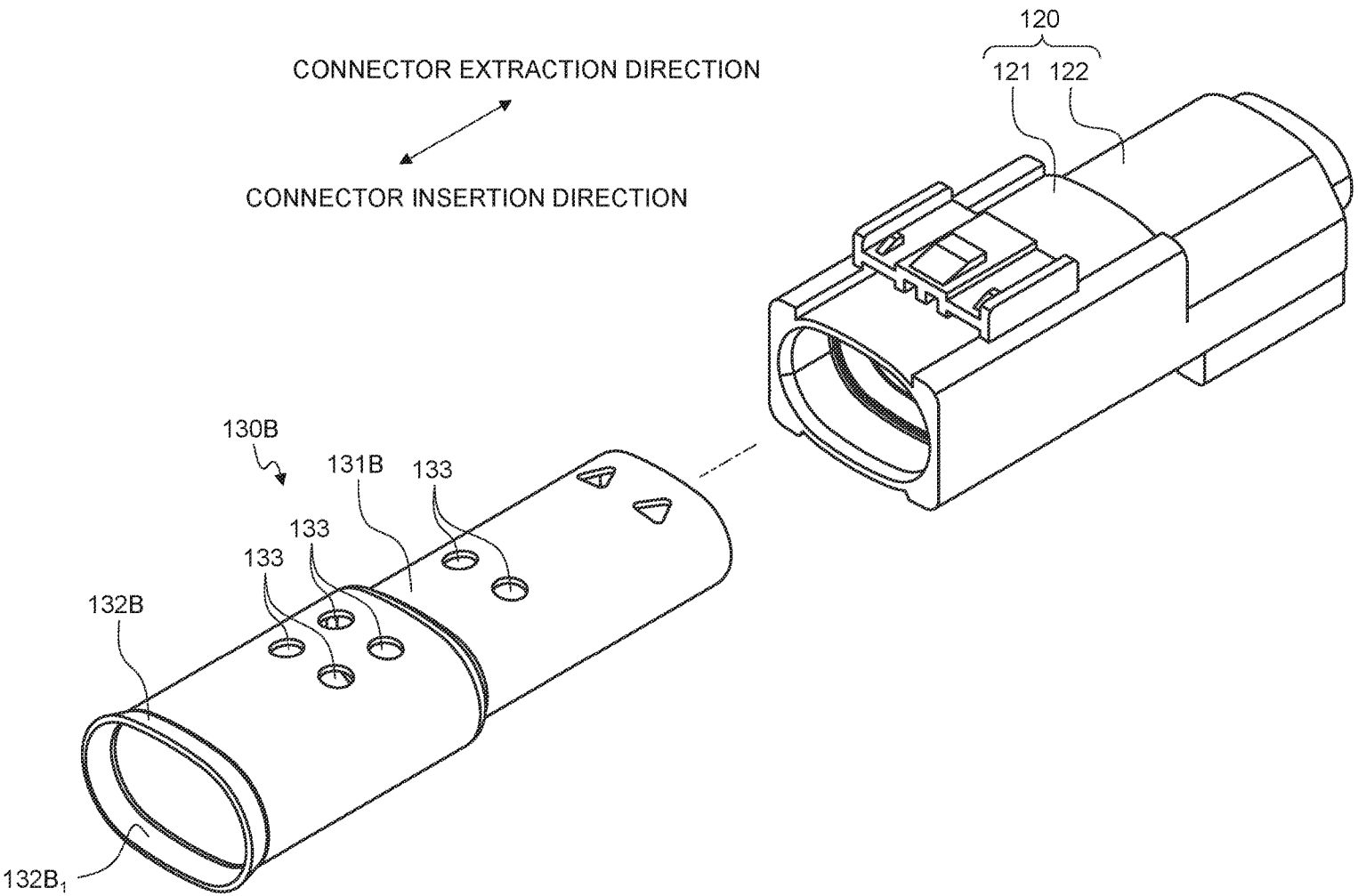
FIG. 18 is an exploded perspective view of the internal components of the male connector of the modified example.

As in the shield shell 130 of the embodiment, the shield shell 130B is formed in a rectangular tubular shape, and the male terminal 110 and the terminal of the electric wire 150 are disposed inside the shield shell 130B (FIG. 17). The shield shell 130B has a rectangular tubular main body portion 131B, and a rectangular tubular end portion 132B provided on the connector insertion direction side of the main body portion 131B (FIG. 18). The shield shell 130B is integrated with the male housing 120 in a state in which the inner circumferential side of its end portion 132B is exposed as an annular exposed surface (FIGS. 17 and 18).

In the shield shell 130B, as in the shield shell 130 of the embodiment, the end portion 132B thereof is formed into a tapered shape, and a tapered surface 132$B_1$ (FIGS. 17 and 18) of the end portion 132B on the inner circumferential side is used as an electrical connection surface. The end portion 132B of this example is inclined so that the sizes of the inner circumferential edge and the outer circumferential edge of the cross-section orthogonal to the connector insertion and extraction direction increase toward the connector insertion direction.

Figure 19:
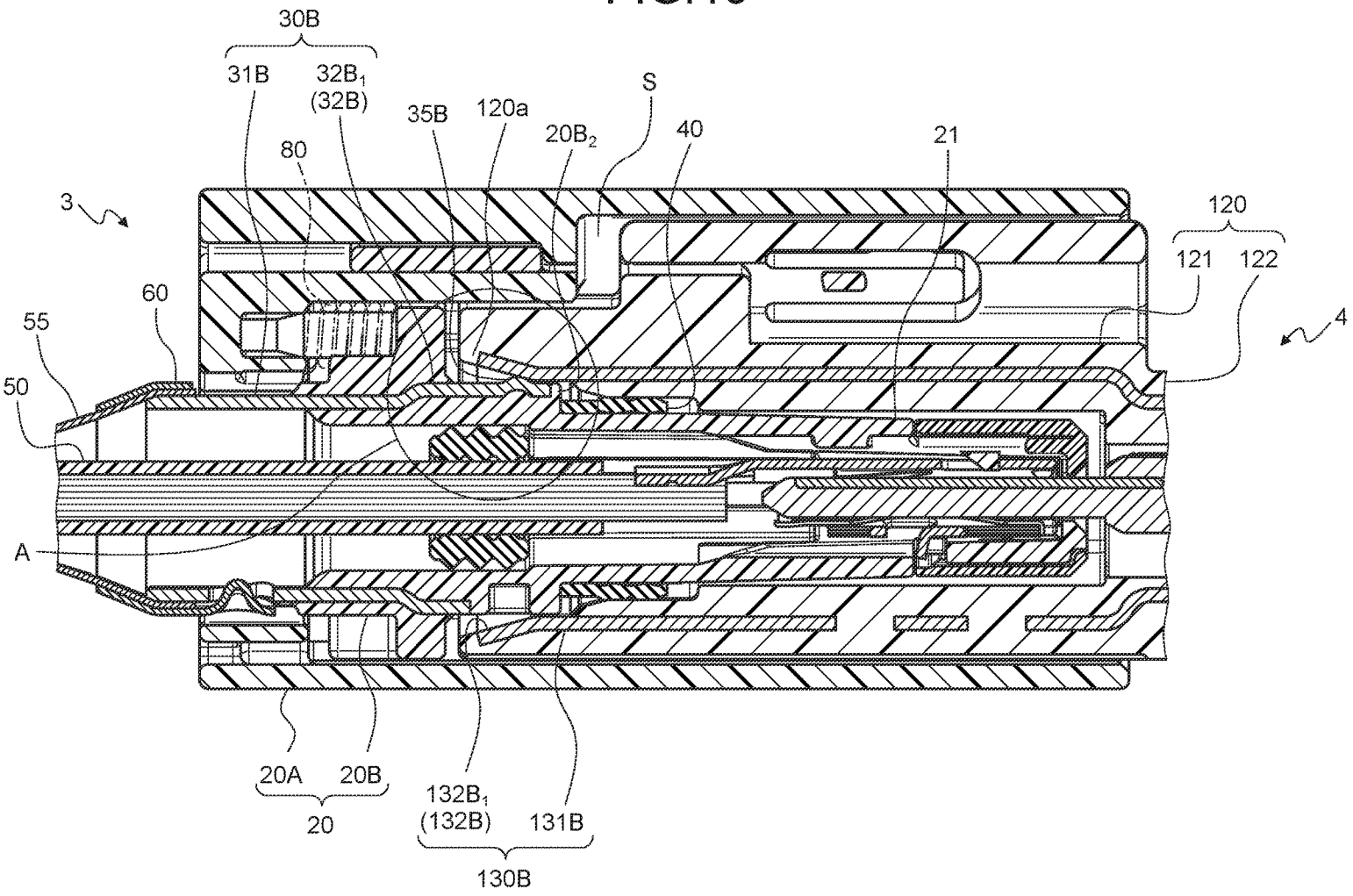
FIG. 19 is a cross-sectional view illustrating a fitted state of the female connector and the male connector of the modified example.

The respective shield shells 30B and 130B are formed so that the protruding portion 35B and the tapered surface 132$B_1$ abut against each other after the female connector 3 and the male connector 4 are completely fitted together (FIG. 19). Meanwhile, it is desirable that each of the shield shells 30B and 130B avoid contact with the tapered surface 132$B_1$ of the end portion 32B (the portion excluding the protruding portion 35B) as much as possible when inserting the connectors. Therefore, in the shield shell 130B, the size of the inner circumferential edge of a cross-section orthogonal to the connector insertion and extraction direction in the main body portion 131B is set as follows. The inner circumferential edge of the main body portion 131B is formed to be larger than the outer circumferential edge of the cross-section orthogonal to the connector insertion and extraction direction in the end portion 32B of the shield shell 30B, and is formed to be smaller than the outer side portion of each protruding portion 35B in the radial direction. As a result, the respective shield shells 30B and 130B can cause the protruding portion 35B and the tapered surface 132$B_1$ to abut against each other after the female connector 3 and the male connector 4 are completely fitted together, while avoiding the contact of the end portion 32B (the portion excluding the protruding portion 35B) to the tapered surface 132$B_1$ as much as possible. At that time, the respective protruding portions 35B are pressed against the tapered surface 132$B_1$ by the resilient force of the elastic member 80. Further, in each of the shield shells 30B and 130B, entry of the protruding portion 35B to the inside of the main body portion 131B is prevented, and the connector fitting is completed in a state in which the protruding portion 35B and the tapered surface 132$B_1$ abut against each other. Therefore, in the respective shield shells 30B and 130B, the sliding movement between the protruding portion 35B and the main body portion 131B or the sliding movement between the end portion 32B and the main body portion 131B can be avoided, while avoiding the contact between the end portion 32B (the portion excluding the protruding portion 35B) and the tapered surface 132$B_1$ as much as possible. Accordingly, it is possible to suppress an increase in insertion and extraction force at the time of inserting and extracting of the connector or peeling of the plating.

Figure 20:
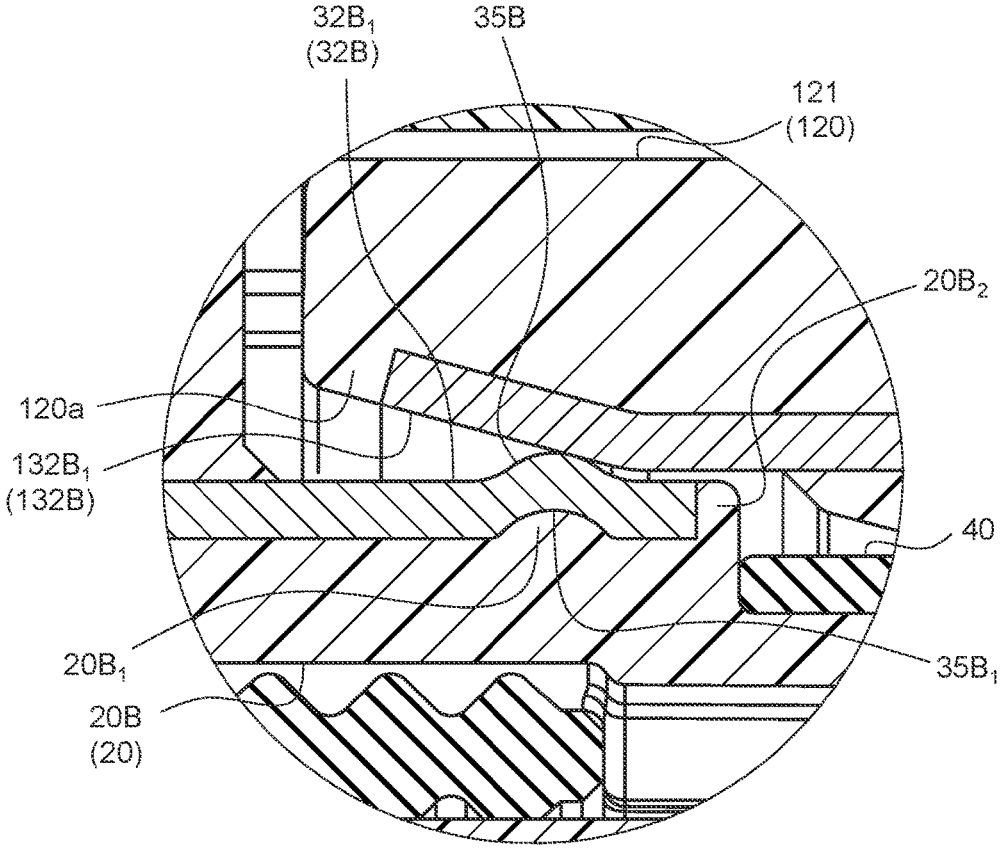
FIG. 20 is an enlarged view of a part A of FIG. 19.

Here, in the female and male connectors, it is preferable to mold the female housing 20 (the inner housing 20B) and the male housing 120 as follows in order to protect the respective shield shells 30B and 130B as in the embodiment. The inner housing 20B is provided with a protection section 20$B_2$ which covers the end surface of the shield shell 30B on the connector insertion direction side (that is, the end surface of the end portion 32B on the connector insertion direction side)(FIGS. 19 and 20). Further, the male housing 120 is provided with a protection section 120*a* which covers the end surface of the shield shell 130B on the connector insertion direction side (that is, the end surface of the end portion 132B on the connector insertion direction side) (FIG. 19). Thus, between the female connector 3 and the male connector 4, the contact of the protruding portion 35B of the shield shell 30B to the end surface of the shield shell 130B in the connector insertion direction is avoided, and the contact of the tapered surface 132$B_1$ to the end surface of the shield shell 30B in the insertion direction connector is avoided. Therefore, in the female and male connectors, it is also possible to protect the respective shield shells 30B and 130B from this point.

As described above, since the female and male connectors of this modified example do not involve the sliding movement between the shield shells 30B and 130B when inserting and extracting the connector, as in the case of the female and male connectors of the embodiment, it is possible to reduce the insertion force at the time of the connector fitting or the extraction force at the time of the connector extracting. Therefore, as in the female and male connectors of the embodiment, since the female and male connectors of this modified example do not need to be provided with a lever mechanism which assists the insertion and extraction force as in the prior art, it is possible to reduce the number of components, the cost and the size.

Furthermore, since the female and male connectors of this modified example can suppress peeling of the plating of the protruding portion 35B or the tapered surface 132$B_1$, as in the case of the female and male connectors of the embodiment, it is possible to maintain the electrical connection state between the shield shells 30B and 130B, while reducing the cost required for the plating.

Furthermore, as in the female and male connectors of the embodiment, the female and male connectors of this modified example include a holding mechanism (which uses the resilient force of the elastic member 80) of the abutment state between the shield shells 30B and 130B which also serves as a rattling suppression mechanism between the female connector 3 and the male connector 4. Therefore, as in the female and male connectors of the embodiment, the female and male connectors are excellent in vibration resistance performance, and are capable of maintaining the electrical connection state between the female terminal 10 and the male terminal 110 and between the shield shells 30B and 130B, respectively. Accordingly, it is possible to maintain the original function of the connector to electrically connect female member and male member, and it is possible to secure the shielding performance of the shield shells 30B and 130B.

Further, as described above, the female and male connectors of this modified example can reduce the size of the shield shell 30B in the radial direction. Therefore, by determining the size of the body of the counterpart shield shell 130B in the radial direction in accordance with the shield shell 30B, it is also possible to reduce the size of the body of the shield shell 130B in the radial direction. Therefore, the female and male connectors of this modified example can be made in smaller size in the radial direction than the female and male connectors of the embodiment.

Since the female and male connectors according to the embodiment have a structure in which the respective shield shells abut against each other and do not involve a sliding movement between the shield shells at the time of connector fitting as in the related art, it is possible to reduce the insertion force at the time of the connector fitting. Also, even at the time of detachment between the first connector and the second connector, the female and male connectors do not involve the sliding movement between the shield shells. Accordingly, the extraction force is reduced. In this way, in the female and male connectors, it is possible to reduce the insertion and extraction force at the time of inserting and extracting the connectors. Furthermore, in the female and male connectors, it is possible to keep the abutment state between the shield shells by the elastic member, and it is possible to suppress an occurrence of rattling between the first connector and the second connector after the connectors are fitted. Therefore, the female and male connectors can suppress the rattling after fitting the connectors, while reducing the insertion and extraction force at the time of insertion and extraction of the connectors.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. Female and male connectors comprising:

a first connector that includes one terminal of a female terminal and a male terminal, an inner housing which holds the one terminal, an outer housing relatively movable to the inner housing in a connector insertion and extraction direction, tubular first shield shell integrated with the inner housing, and an elastic member which is disposed between the outer housing and the inner housing to exert an resilient force on at least one of the inner housing and the first shield shell; and a second connector that includes the other terminal of the female terminal and the male terminal, a housing which holds the other terminal, and tubular second shield shell integrated with the housing, wherein the male terminal is inserted in the female terminal when the first connector is connected to the second connector, and the first shield shell abuts against the second shield shell when the first connector is connected to the second connector, is pressed against the second shield shell by the resilient force of the elastic member when the first connector is connected to the second connector, and the first shield shell is electrically connected to the second shield shell when the first connector is connected to the second connector.

2. The female and male connectors according to claim 1, wherein the first shield shell and the second shield shell are configured so that at least a part of an outer circumferential surface of an end portion of one shield shell of the shield shells on the one shield shell's own connector insertion direction side is set as a first tapered surface inclined to the connector insertion and extraction direction, at least a part of an inner circumferential surface of an end portion of the other shield shell of the shield shells on the other shield shell's own connector insertion direction side is set as a second tapered surface inclined to the connector insertion and extraction direction, and the first tapered surface side and the second tapered surface side are made to abut against each other with the connector insertion.

3. The female and male connectors according to claim 2, wherein the first tapered surface is inclined so that a size of an outer circumferential edge of a cross-section orthogonal to the connector insertion and extraction direction on the outer circumferential surface decreases toward the one shield shell's own connector insertion direction, and the second tapered surface is inclined so that a size of an inner circumferential edge of the cross-section orthogonal to the connector insertion and extraction direction on the inner circumferential surface increases toward the other shield shell's own connector insertion direction.

4. The female and male connectors according to claim 2, wherein at least one of the first tapered surface and the second tapered surface is provided with at least one protruding portion protruding toward a counterpart tapered surface which is an abutment target.

5. The female and male connectors according to claim 3, wherein at least one of the first tapered surface and the second tapered surface is provided with at least one protruding portion protruding toward a counterpart tapered surface which is an abutment target.

6. The female and male connectors according to claim 1, wherein one shield shell of the first shield shell and the second shield shell has a tapered surface inclined to the connector insertion and extraction direction, at an end portion on the one shield shell's own connector insertion direction side, the other shield shell of the first shield shell and the second shield shell has at least one protruding portion protruding toward the tapered surface, at an end portion on the other shield shell's own connector insertion direction side, and the first shield shell and the second shield shell make the tapered surface and the protruding portion to abut against each other with insertion of the first connector and the second connector.

7. The female and male connectors according to claim 6, wherein the end portion of the other shield shell of the first shield shell and the second shield shell on the other shield shell's own connector insertion direction side extends in the other shield shell's own connector insertion direction side along the connector insertion and extraction direction.

* * * * *